US012054941B2

(12) United States Patent
Von Malm

(10) Patent No.: US 12,054,941 B2
(45) Date of Patent: Aug. 6, 2024

(54) WALL BLOCK, RANGE OF WALL BLOCKS, AND FORMWORK FOR PRODUCING A WALL BLOCK

(71) Applicant: Start Somewhere Gemeinnützige GmbH, Munich (DE)

(72) Inventor: Oliver Von Malm, Munich (DE)

(73) Assignee: Start Somewhere Gemeinnutzige GmbH, Munich (DE)

( * ) Notice: Subject to any disclaimer, the term of this patent is extended or adjusted under 35 U.S.C. 154(b) by 140 days.

(21) Appl. No.: 17/285,061

(22) PCT Filed: Oct. 14, 2019

(86) PCT No.: PCT/EP2019/077733
§ 371 (c)(1),
(2) Date: Apr. 13, 2021

(87) PCT Pub. No.: WO2020/078878
PCT Pub. Date: Apr. 23, 2020

(65) Prior Publication Data

US 2021/0348383 A1 Nov. 11, 2021

(30) Foreign Application Priority Data

Oct. 15, 2018 (DE) ..... 10 2018 125 548.9

(51) Int. Cl.
*E04B 2/18* (2006.01)
*E04B 2/02* (2006.01)
*E04C 3/22* (2006.01)

(52) U.S. Cl.
CPC ..... *E04B 2/18* (2013.01); *E04B 2002/0213* (2013.01); *E04B 2002/0215* (2013.01); *E04B 2002/0265* (2013.01); *E04C 3/22* (2013.01)

(58) Field of Classification Search
CPC ..... E04B 2/18; E04B 2002/0265
(Continued)

(56) References Cited

U.S. PATENT DOCUMENTS 1,684,050 A * 9/1928 Adams ..... E04B 2/06
52/590.2
1,768,651 A * 7/1930 Wyatt ..... E04B 2/28
52/351

(Continued)

FOREIGN PATENT DOCUMENTS

AT 373657 B 2/1984
BE 849332 A 6/1977

(Continued)

OTHER PUBLICATIONS

International Search Report for corresponding PCT Application No. PCT/EP2019/077733 mailed Feb. 24, 2020.

(Continued)

*Primary Examiner* — Brian D Mattei
*Assistant Examiner* — Joseph J. Sadlon
(74) *Attorney, Agent, or Firm* — Wood, Phillips, Katz, Clark & Mortimer

(57) ABSTRACT

Wall block (2) made of artificial stone material; it has an overall elongate form and a first seating surface (10); an opposing second seating face (12); a first end face (14); an opposing second end face (16); a first wall surface side (18); an opposing second wall surface side (20); it has, on its first seating face, a first seating surface (4) and, on its second seating face, a second seating surface (6); it has a lateral surface (8) and a plurality of extension arrangements (30)

(Continued)

arranged in a row on its first seating face (10) and a plurality of receiving arrangements (40) arranged in a row on its second seating face (12), these arrangements each being complementary to one another such that a particular extension arrangement fits in form-fitting engagement with a particular receiving arrangement of a third further wall block which is designed as a receiving arrangement of the claimed wall block, and such that a particular receiving arrangement fits in form-fitting engagement with a particular extension arrangement of a fourth further wall block which is designed as an extension arrangement of the claimed wall block, the particular extension arrangement and the particular receiving arrangement being designed such that the form-fitting engagement—considered per se—is possible both when the longitudinal central axes of the claimed wall block and of the third further or fourth further wall block are parallel to one another and when the longitudinal central axes of the claimed wall block and of the third further or fourth further wall block—seen in plan view of the first seating face or the second seating face of the claimed wall block—extend at an angle (81) to one another; and it is formed having a fin (60) at the transition between its first end face and its first wall surface side, and/or at the transition between its first end face and its second wall surface side, which fin protrudes beyond a virtual flat surface (61) located at the center of the first end face at a right angle to the longitudinal axis of the wall block.

19 Claims, 14 Drawing Sheets

(58) Field of Classification Search
USPC ..... 52/604
See application file for complete search history.

(56) References Cited

U.S. PATENT DOCUMENTS 2,351,615 A * 6/1944 Robert ..... E04B 2/56 52/258
2,826,906 A * 3/1958 Rice ..... E04B 2/16 52/270
2,888,779 A * 6/1959 Hostetter ..... A01G 9/28 47/33
2,942,115 A * 6/1960 Thomas ..... G21F 3/04 250/517.1
3,073,061 A * 1/1963 Pearson ..... E04B 2/22 52/27
3,382,632 A * 5/1968 Grofcsik ..... E04B 2/10 52/223.7
3,828,502 A * 8/1974 Carlsson ..... E04C 2/292 52/125.4
3,864,885 A * 2/1975 Muse ..... E04B 2/44 52/439
4,229,123 A * 10/1980 Heinzmann ..... E02D 29/025 47/33
4,514,949 A * 5/1985 Crespo ..... E04B 2/18 52/603
4,521,138 A * 6/1985 Steiner ..... E02B 3/14 D25/113
4,752,203 A * 6/1988 Kanzaki ..... B28B 1/20 425/434
4,866,891 A * 9/1989 Young ..... E04B 2/8641 52/426
4,965,979 A * 10/1990 Larrivee ..... E04C 1/395 52/592.6
5,003,746 A * 4/1991 Wilston ..... A63H 33/08 52/592.1
5,080,523 A * 1/1992 Steiner ..... E01F 15/083 47/33
5,154,032 A 10/1992 Ritter
5,160,212 A * 11/1992 Vauhkonen ..... E04B 2/06 403/294
5,490,363 A * 2/1996 Woolford ..... B28B 7/0097 52/169.4
5,601,384 A * 2/1997 Dawson ..... E02D 29/0266 405/284
D378,423 S * 3/1997 Henry ..... D25/116
5,657,600 A * 8/1997 Mensen ..... E04C 1/40 52/426
6,000,186 A * 12/1999 Fielding ..... E04B 2/18 52/564
6,038,822 A * 3/2000 Keys ..... E04B 2/26 52/98
6,105,307 A * 8/2000 Helmy ..... A01G 9/28 47/65.5
6,115,983 A * 9/2000 Poignard ..... E04C 1/395 52/568
D435,305 S * 12/2000 Pullen ..... D25/164
6,161,357 A * 12/2000 Altemus ..... E04B 2/24 446/124
6,394,705 B1 * 5/2002 Lefebvre ..... E04C 1/395 52/592.1
6,557,818 B2 * 5/2003 Manthci ..... B28B 23/0056 249/176
7,971,407 B2 * 7/2011 MacDonald ..... B28B 23/0056 249/176
8,079,195 B2 * 12/2011 Cables ..... B28D 1/02
8,136,325 B1 * 3/2012 Van Lerberg ..... E04C 1/395
8,601,758 B2 * 12/2013 Biadora ..... E04B 2/06 D25/116
8,677,713 B1 * 3/2014 Sheehy ..... E04C 2/388 D25/164
9,068,351 B1 * 6/2015 Biadora ..... E04C 1/397
9,133,619 B1 * 9/2015 Roberts ..... E04B 2/10
9,404,234 B2 * 8/2016 Jain ..... E04B 2/08
9,617,745 B2 * 4/2017 Mackay Sim ..... E04C 1/40 52/596
9,689,160 B2 * 6/2017 Lanese ..... E04B 2/08
10,080,979 B2 * 9/2018 Lane ..... A63H 33/32
10,273,649 B2 * 4/2019 Lonero ..... B28D 1/02
10,273,683 B2 * 4/2019 Fryfogle ..... E04B 2/12
2002/0187010 A1 * 12/2002 MacDonald ..... E02D 29/025 405/286
2004/0154256 A1 * 8/2004 Kim ..... E04B 2/08 52/592.6
2004/0177580 A1 * 9/2004 Tremelling ..... E04B 2/8635 52/565
2007/0193183 A1 * 8/2007 Price ..... E04C 1/395 52/596
2008/0060313 A1 * 3/2008 Edwards ..... E04B 2/18 52/606
2009/0173027 A1 * 7/2009 Bennett ..... E04C 1/40 52/596
2011/0239570 A1 10/2011 Bennett
2016/0222655 A1 * 8/2016 Lin ..... E04C 1/395
2016/0309893 A1 * 10/2016 Plikat ..... A47B 21/02

FOREIGN PATENT DOCUMENTS

DE 8211843 U1 4/1982
DE 19512651 A1 * 10/1996 ..... E01C 5/00
DE 19713037 A1 1/1998
DE 202007018469 U1 10/2008
EP 0163117 A1 * 12/1985 ..... E04C 1/40
EP 2894270 A1 * 7/2015 ..... E04B 2/18
EP 3867455 B1 11/2022
ES 2555633 A1 * 1/2016 ..... E04B 1/04
FR 1120671 A 7/1956
FR 2693755 A1 * 1/1994 ..... E04C 1/395
FR 2729601 A1 * 7/1996 ..... B28B 7/44
FR 3040406 A3 * 3/2017 ..... E04B 2/18
GB 2095713 A * 10/1982 ..... E04B 2/18
GB 2472068 A * 1/2011 ..... E04B 2/8629
GB 2536917 A 10/2016
KR 970000253 Y1 * 1/1997 ..... E04B 2/06
SE 467217 B * 6/1992 ..... E04B 2/18

(56) References Cited

FOREIGN PATENT DOCUMENTS

| | | | | | |
|---|---|---|---|---|---|
| WO | WO-2015024134 | A1 * | 2/2015 | ..... | E04B 2/18 |
| WO | WO-2015187358 | A1 * | 12/2015 | ..... | E02D 29/02 |
| WO | WO-2017132425 | A1 * | 8/2017 | ..... | B28B 7/002 |
| WO | 2018075493 | A1 | 4/2018 | | |

OTHER PUBLICATIONS

German Search Report for corresponding application No. M2135.5 mailed Jun. 9, 2019.

* cited by examiner 2
58
60
16
14
18
62
64
66
68
70
72
73
74
61

WALL BLOCK, RANGE OF WALL BLOCKS, AND FORMWORK FOR PRODUCING A WALL BLOCK

FIELD OF THE INVENTION

The invention relates to a wall block made of artificial stone material, having the following features:

BACKGROUND OF THE INVENTION

The wall block has an overall elongate form with a longitudinal central axis and with a length that is greater than the width of the wall block, and the wall block comprises:

- a first seating face, which is provided as an upper face of the wall block or as a lower face of the wall block;
- an opposing second seating face which is provided as the other of the upper face of the wall block or lower face of the wall block;
- a first end face which is provided to face a first further wall block which is adjacent to the claimed wall block in the longitudinal direction;
- an opposing second end face which is provided to face a second further wall block which is adjacent to the claimed wall block in the longitudinal direction;
- a first wall surface side which is provided to be part of a first wall surface;
- an opposing second wall surface side which is provided to be part of an opposing second wall surface;
- the wall block has, on its first seating face, a first seating surface which is provided for compressive-force transmission with at least a third further wall block that is adjacent in height;
- the wall block has, on its second seating face, a second seating surface which is provided for compressive-force transmission with at least a fourth further wall block that is adjacent in height;
- the wall block has a lateral surface which extends on its first end face, its first wall surface side, its second end face and its second wall surface side;
- the wall block has, on its first seating face, a plurality of extension arrangements arranged in a row and, on its second seating face, a plurality of receiving arrangements arranged in a row, the extension arrangements and the receiving arrangements each being complementary to one another such that a particular extension arrangement fits in form-fitting engagement with a particular receiving arrangement of a third further wall block which is designed as a receiving arrangement of the claimed wall block, and such that a particular receiving arrangement fits in form-fitting engagement with a particular extension arrangement of a fourth further wall block which is designed as an extension arrangement of the claimed wall block,
- the particular extension arrangement and the particular receiving arrangement being designed such that the form-fitting engagement—considered per se—is possible both when the longitudinal central axes of the claimed wall block and of the third further or fourth further wall block are parallel to one another and when the longitudinal central axes of the claimed wall block and of the third further or fourth further wall block—seen in plan view of the first seating face or the second seating face of the claimed wall block—extend at an angle to one another; and
- the wall block is formed having a fin at the transition between its first end face and its first wall surface side, and/or at the transition between its first end face and its second wall surface side, which fin protrudes beyond a virtual flat surface located at the center of the first end face at a right angle to the longitudinal axis of the wall block.

The wall block can additionally be formed having a fin at the transition between its second end face and its first wall surface side, and/or additionally at the transition between its second end face and its second wall surface side, which fin protrudes beyond a virtual flat surface located at the center of the second end face at a right angle to the longitudinal axis of the wall block.

Wall blocks are used so that it is possible to build walls therefrom in an expedient configuration. Walls are three-dimensional structures which have a more or less great length (sometimes, when standing in front of the wall, it is said that the wall has a width of so-and-so many meters), a more or less great height, and a—not necessarily consistently constant—depth (which could also be referred to as "thickness" or "wall thickness"). The construction is often such that the wall is formed by a plurality of rows, each consisting of wall blocks adjoining one another in the longitudinal direction of the wall, and a plurality of wall-block rows one on top of the other.

Wall blocks made of artificial stone material are known in all kinds of designs. Previously, only wall blocks were considered which were positioned adjoining one another in a substantially straight line in the longitudinal direction of the wall, and 90° corners of the wall could also be created. When considering the construction of walls having a 90° bend, either makeshift solutions with imperfect continuation of the wall at the point of the bend were used or special wall blocks having exactly one shape reflecting this bend were provided. In the case of wall bends, the known wall block designs have either yielded poor results or have left the user of the wall blocks with no flexibility. Wall blocks which allow the variable construction of walls having bends that deviate from 90° have previously not allowed the construction of walls having at least substantially continuously closed wall surface sides and having resistance against the penetration of wind and rain.

The problem addressed by the invention is that of providing a wall block made of artificial stone material which makes it possible for walls having selectable bends to be constructed as desired, there being good cohesion of adjacent wall blocks across the angle and the transitions from wall block to wall block in the rows of wall blocks, whether in the case of a bend or in the case of a straight wall portion, being functionally improved (appearance, stability, wall tightness).

BRIEF SUMMARY OF THE INVENTION

To solve this problem, the wall block according to the invention is made of artificial stone material, as specified in the first paragraph of the present application.

For the sake of brevity, in the following reference is made throughout to "wall block" or just "block" instead of "wall block made of artificial stone material." In order to have a more easily imaginable picture at this point, it is hereby disclosed that concrete is a good artificial stone material for the wall block according to the invention. Alternative possible artificial stone materials are specifically addressed below.

The wall block according to the invention has, on its first seating face, protruding extension arrangements; the first seating face could therefore also be referred to as the "male seating face" of the wall block. The wall block according to the invention has, on its second seating face, internally accessible receiving arrangements; the second seating face could therefore also be referred to as the "female seating face" of the wall block. The wall block can be inserted in a wall such that its first seating face faces upward and its second seating face faces downward ("male is at the top"), or alternatively inserted such that its second seating face faces upward and its first seating face faces downward ("female is at the top"). In most cases, the relevant orientation of these two orientations remains the same at least for a portion of the wall, as will become clearer below in the embodiments.

When two wall blocks positioned one above the other—completely or with a mutual offset—having at least one pair of an extension arrangement and receiving arrangement are in form-fitting engagement with one another, these two wall blocks are prevented from relative movement of one wall block relative to the other in the "horizontal direction." However, the wall block does not necessarily have to be designed such that the above-mentioned hindrance of the relative movement in all conceivable directions in the "horizontal plane" of engagement is prevented. It is possible to design the wall block such that said prevention of the relative movement takes effect only for part of the total conceivable relative movement directions over 360°. It is therefore possible, for example, that the relative movement of the two wall blocks is prevented if—in plan view of the first seating faces or the second seating faces—there is no angle or an angle between 0° and 45° between the longitudinal central axes of the two wall blocks, but that the relative movement of the two wall blocks is not prevented if, for example, there is an angle of 90° between the longitudinal central axes of the two wall blocks. This will become clearer below in the embodiments.

When, in the first passage of the application (=claim 1), it is mentioned that the form-fitting engagement between the extension arrangement of one wall block and the receiving arrangement of another wall block—considered per se—is possible irrespective of whether the longitudinal central axes of the two wall blocks are parallel to one another or whether there is an angle between the two longitudinal central axes, this is a statement regarding the basic relative pivotability, which arises in this form-fitting engagement, of the two wall blocks involved about a "vertical axis," with a somewhat narrowed view only of the form-fitting engagement. Due to other features of the wall block, it may feasibly be the case that "form-fitting engagement is possible irrespective of whether the two longitudinal central axes involved are parallel to one another or have an angle to one another" applies only for part of the total conceivable 360° of pivot angles. An example of "relative pivoting—considered per se—possible, but concretely not feasible due to other circumstances" is a wall block having two extension arrangements and two receiving arrangements. If two such wall blocks are placed one on top of the other without longitudinal offset, relative pivoting is not possible. If, in contrast, the two wall blocks are placed one on top of the another with a longitudinal offset by substantially half a wall block length, the form-fitting engagement of the pair of the extension arrangement and the receiving arrangement—considered per se—allows relative pivoting, provided that the relative pivoting is not prevented or limited by other features; see details below.

In this application, reference is made at many points to "horizontal" or "horizontal direction" and to "vertical" and "vertical direction." These are not intended to be statements on "vertical" and "horizontal" in a geometric sense, but are merely concise statements that allow the reader to quickly orient himself about the meaning. If, for example, a wall is constructed on a slightly inclined garage driveway, the straight line that is at a right angle to the seating face of the wall blocks is not a vertical straight line in a geometric sense, but it is a line "from bottom to top" and in most cases is substantially vertical. In the same example, the general orientation of the first seating face and the general orientation of the second seating face are not geometrically horizontal, strictly speaking. It could also be said that "vertical direction" refers to the direction that results when progressing from one wall block to the next wall block positioned above or below. And it could also be said that "horizontal direction" refers to the direction that results when moving in the direction of the flush longitudinal central axes of the wall blocks in a row of wall blocks.

When reference is made in this application to "claimed wall block," this refers to the wall block claimed by the relevant claim and naturally has nothing to do with stress due to forces or the like.

All the statements in this application related to geometry specifications and size specifications in a wall block under consideration, and all the statements in this application related to geometric relations or to size relations between two adjacent wall blocks, are to be understood in light of the fact that it is common in the technical field of wall blocks made of artificial stone material to manufacture wall blocks with relatively large production tolerances. In order for adjacent wall blocks to fit together, certain dimensions must always be produced with a production tolerance in the minus range. For example, the extension arrangements must be made "slightly smaller" than the "receiving arrangements" to which they are complementary and with which they are intended to fit together in form-fitting engagement. "Complementary to one another" therefore does not mean "exactly fitting one inside the other" and "form-fitting engagement" does not mean "mutual engagement without backlash."

The wall block according to the invention can be designed such that it is possible to place two wall blocks one on top of the other free of joining material (e.g. mortar) therebetween and still have the required force transmission capacity "in the vertical direction" and "in the horizontal direction." The form-fitting engagement between the extension arrangement and the receiving arrangement not only fulfils a purpose in the force transmission in the horizontal direction, but is also a good positioning aid for the person constructing a wall out of wall blocks. The wall block placed on top is already substantially correctly placed on the lower wall block due to the form-fitting engagement. Of course, this statement does not exclude the possibility of placing or positioning the wall blocks according to the invention on top of one another with joining material (e.g. mortar) therebetween. In this case, the cohesion of the two wall blocks involved is more extensive and the wall is tight against wind and water. On the other hand, an existing wall can no longer be easily dismantled.

When reference is made in this application to "adjacent," this is not intended to mean "directly adjacent" or "directly adjoining." Instead, the meaning should be that there is no other wall block between a wall block under consideration and an adjacent wall block, whether this be in the horizontal direction or in the vertical direction, depending on the context. Nevertheless, with the exception of any mortar layers, in the invention adjacent wall blocks are positioned "close together," although this does not mean immediate mutual contact in the horizontal direction due to the manufacturing tolerances mentioned above. This is possible, but not absolutely necessary. When reference is made in this application to a further wall block being positioned above or below a wall block under consideration, this is not intended to mean that the further wall block is substantially the same continuation of the wall block under consideration. Rather, this is merely intended to express a higher-positioning or a lower-positioning of the further wall block. As will become clearer below, there is quite often the situation during the construction of walls that a higher positioned further wall block or a lower positioned further wall block has an offset with respect to a wall block under consideration, i.e. in simplified terms, for example, only one half thereof sits on the wall block under consideration or only one half thereof sits directly below the wall block under consideration.

The wall block according to the invention, which has the features mentioned in the opening passage of the application (=claim 1) and can have one or more of the further features disclosed above, can also be characterized in that in each case an extension arrangement and a receiving arrangement are arranged one above the other with a common central axis. This design has the result that the wall blocks can be easily used in great variability of mutual positioning.

The wall block according to the invention, which has the features mentioned in the opening passage of the application (=claim 1) and can have one or more of the further features disclosed above, can also be characterized in that it has a single free passage or a plurality of free passages passing from its first seating face to its second seating face. Wall blocks designed in this way require less artificial stone material, are lighter and are advantageous with regard to thermal insulation. Further advantages will become clear below. At this point, it is emphasized that the wall block according to the invention can be designed in terms of weight and size such that it can be carried and placed or positioned by a person. It is possible to design the wall block according to the invention having a central floor which extends substantially parallel to the seating face of the wall block. This floor can be continuous as a whole (in which case the wall block has no continuous passage), but it can also have one or more openings.

The wall block according to the invention, which has the features mentioned in the opening passage of the application (=claim 1) and can have one or more of the further features disclosed above, can also be characterized in that each extension arrangement has such a design of its outer face facing outward away from the center of the extension arrangement and each receiving arrangement has such a design of its inner face facing inward toward the center of the receiving arrangement that continuous arched, form-fitting engagement or interrupted arched, form-fitting engagement with the complementary receiving arrangement and extension arrangement, respectively, of the third further or fourth further wall block is possible.

In this way, the conditions for a variable-angle, form-fitting engagement can be created in a simple manner. "Interrupted arched, form-fitting engagement" means that the engagement surface of the relevant extension arrangement and/or the relevant receiving arrangement is not continuous, but has gaps or interruptions. For example, an extension arrangement which, viewed as a whole, extends over an angular range of 180° can be divided into three parts each having an angular range of 50°, and two interruptions each having an angular range of 15°. Correspondingly, interruption recesses are also possible in the engagement surface of the receiving arrangement. In this context, it is functionally essential to be able to place an arched envelope line in the extension arrangement or the receiving arrangement.

It is favorable if, at the outer face of each extension arrangement and at the inner face of each receiving arrangement, the design for arched form-fitting engagement extends over an angular range having a size of at least 180° and at most 360°. "At least 180°" provides favorable conditions for good engagement of adjacent wall blocks. If it is desired to implement with much more than 180°, this requires consideration in the other wall block design for wall blocks having continuous passages from the first seating face to the second seating face. Angular ranges that are slightly greater than 180°, in particular that have a size between 180° and 200°, are very advantageous.

The wall block according to the invention, which has the features mentioned in the opening passage of the application (=claim 1) and can have one or more of the further features disclosed above, can also be characterized in that it has only two extension arrangements and two receiving arrangements; and in that the centers of the two extension arrangements and the centers of the two receiving arrangements are symmetrical to the transverse central axis of the wall block, which is located between the center of the first end face and the center of the second end face. It is possible to make the design such that the centers of the two extension arrangements and the centers of the two receiving arrangements have a spacing from one another which corresponds substantially to half the length of the wall block, measured between the centers of the first end face and the second end face.

The design of the wall block according to the previous paragraph makes a great variability in the construction of walls accessible. The wording "spacing of the two centers which substantially corresponds to half the length of the wall block" in practice amounts to the spacing of the two centers being slightly greater than half the length of the wall block, so that in the case of two wall blocks positioned adjacently in the longitudinal direction—in the sense of negative production tolerance—a little free space remains if, in the row of wall blocks above or the row of wall blocks below, the wall blocks are placed with a longitudinal offset with respect to the row of wall blocks under consideration. In the case of non-arched engagement surfaces, the term "centers" is to be understood to mean that an expedient center for the extension arrangement or the receiving arrangement, as seen in plan view of the first seating face or the second seating face, is considered.

The above-mentioned fin(s) increase(s) the stability of walls constructed using such wall blocks against forces acting against the first wall surface side or against the second wall surface side, e.g. wind forces or impact forces. The tightness of the wall against wind and rain is also improved. In addition, this also results in a smoother appearance of the first wall surface side and/or of the second wall surface side.

The wall block according to the invention, which has the features mentioned in the opening passage of the application (=claim 1) and can have one or more of the further features disclosed above, can also be characterized in that its first end face and/or its second end face, in comparison with a virtual flat surface which is located in the center of the relevant end face at a right angle to the longitudinal central axis, is set back toward the wall block, at least in regions, on both sides of the relevant end face center, with the exception of the region or regions where an above-mentioned fin protrudes. In many wall block geometries, these recesses make it easier to connect a first further wall block and/or a second further wall block with angles between the longitudinal central axes. The first end face and/or the second end face can be designed—in plan view of the first seating face or the second seating face—to be outwardly convex and semicircularly rounded, with the exception of the region or regions where an above-mentioned fin protrudes.

The wall block according to the invention, which has the features mentioned in the opening passage of the application (=claim 1) and can have one or more of the further features disclosed above, can also be characterized in that at least one of the fins is dimensioned such that it substantially reaches as far as an end face of an adjacently positioned first further or second further wall block which is designed as a fin-free end face of the claimed wall block.

This design increases the tightness of a wall constructed using wall blocks according to the invention and the stability of the wall against forces against the first or second wall surface side.

The wall block according to the invention, which has the features mentioned in the opening passage of the application (=claim 1) and can have one or more of the further features disclosed above, can also be characterized in that at least one of the fins protrudes so far that in a situation in which the claimed wall block is positioned adjacently to a first further or a second further wall block, with said fin facing the adjacent wall block, it is possible for the claimed wall block to pivot relative to the adjacent wall block about the central axis of the extension arrangement of the adjacent wall block nearest to the claimed wall block at least in one of the two pivoting directions as far as a maximum angle, which has a value of less than 90°, but it is not possible for the claimed wall block to pivot further beyond the maximum angle, due to blocking abutment of said fin against the adjacent wall block, without moving the two relevant wall blocks apart. A maximum angle that is slightly smaller than 90° is possible. A maximum angle having a value in the range of from 25° to 50° is possible. A maximum angle of substantially 45° or slightly more than 45° is possible.

The embodiments according to the preceding paragraph achieved an optimal compromise with regard to variability as well as cohesion and stability of the constructed wall. If the claimed wall block has two fins facing the adjacent wall block, the increase in stability is more pronounced and effective in two directions.

The wall block according to the invention, which has the features mentioned in the opening passage of the application (=claim 1) and can have one or more of the further features disclosed above, can also be characterized in that its second end face is overall outwardly convex and semicircularly rounded and one or two fins are provided on its first end face, and in that the extent of protrusion of the one fin or of the two fins, over the above-mentioned virtual flat surface, is smaller than the spacing between the center of the first end face and the center of the nearest adjacent extension arrangement of the wall block or of the nearest adjacent receiving arrangement of the wall block.

The wall block according to the invention, which has the features mentioned in the opening passage of the application (=claim 1) and can have one or more of the further features disclosed above, can also be characterized in that the end face(s) on which at least one fin is provided is/are set back toward the wall block in comparison with the central region of a virtual arc which begins tangentially in the center of the relevant end face and extends to the end of the relevant fin, the extent to which it is/they are set back being so great that an empty pocket remains there when a first further wall block or a second further wall block having an overall outwardly convex and semicircularly rounded end face is positioned adjacently.

The above-mentioned pocket can be, but does not need to be, filled with pourable material after the relevant wall block or a larger number of wall blocks has/have been placed. Further details follow below.

The wall block according to the invention, which has the features mentioned in the opening passage of the application (=claim 1) and can have one or more of the further features disclosed above, can also be characterized in that, in the case of each extension arrangement, a portion of its first seating surface is located between its outer face facing outward from the center and the lateral surface of the wall block located there.

In this way, as much of the first seating face of the wall block as possible is used to create the first seating surface.

The wall block according to the invention, which has the features mentioned in the opening passage of the application (=claim 1) and can have one or more of the further features disclosed above, can also be characterized in that it has a single free passage passing from its first seating face to its second seating face;

- in that it consists—with the exception of the at least one above-mentioned fin—substantially only of a peripheral wall having two rounded portions on two end faces of the wall block and two straight portions between the two rounded portions, as well as two extension arrangements and two receiving arrangements;
- in that the two extension arrangements are offset toward the inside of the wall block with respect to the main part of the height of the peripheral wall;
- and in that the two receiving arrangements are formed using portions of the inner faces of the rounded portions, in particular part of the height of the rounded portions.

Such a wall block has a good compromise between strength, low material use and great utilization of the seating surface despite the extension arrangements and receiving arrangements.

In the wall block described in the last paragraph but one, it can be provided that the two straight portions of the peripheral wall each have a greater wall strength in their central regions than the wall strength of the peripheral wall in the rounded portions; and that, on the first seating face, the first seating surface is widened in each case in the region of the relevant above-mentioned central region toward the inside of the wall block, beyond the above-mentioned greater wall thickness. This increases the stability of the wall block, especially in the central region of the wall block, which is particularly useful for this purpose.

The wall block according to the invention, which has the features mentioned in the opening passage of the application (=claim 1) and can have one or more of the further features disclosed above, can also be characterized in that an opening is provided in each case in its first end face and its second end face. With these openings, conditions are created whereby adjacent wall blocks in the longitudinal direction of the wall block can be directly linked to one another in order to increase the force transmission capacity.

The wall block according to the invention, which has the features mentioned in the opening passage of the application (=claim 1) and can have one or more of the further features disclosed above, can also be characterized in that it has an integrally formed or separately inserted end plate adjacent to its first seating face or its second seating face; and in that an opening is provided in each case in its first end face and its second end face.

Due to these features, pourable material can be introduced into the interior of the wall block on the end plate. In addition, adjacent wall blocks in the longitudinal direction of the wall block can be linked in order to increase the force transmission capacity.

The invention also provides a wall block which can have one or more of the further features disclosed above and which is additionally wider in the region of its first end face than in the region of its second end face. Such a wall block makes it possible to conveniently produce a transition between a wall region of greater wall thickness and a region of smaller wall thickness.

As artificial stone material for the wall block according to the invention, many materials can be considered which can be brought into the shape of the wall block in a first, forming state, and which subsequently—usually after a hardening process—retain the shape of the wall block with the required strength. Specific materials under consideration include compacted clay, geopolymers, sand-lime bricks, bricks and—as already mentioned above as a prominent material—concrete. In the case of concrete, the desired strength can be varied in particular by varying the cement amount and selecting the grain size of the sand or gravel.

It is hereby expressly disclosed that the invention also provides a wall block which does not necessarily have an "overall elongate form with a length that is greater than its width," but—with the exception of the fin(s)—can also be substantially as long as it is wide, and which does not necessarily have "a plurality of extension arrangements arranged in a row" and "a plurality of receiving arrangements arranged in a row," but can also be provided with only one extension arrangement and only one receiving arrangement, this wall block otherwise having all the features mentioned in the opening passage of the application (=claim 1) and being able to have one or more of the further features disclosed above. The wall block mentioned in this paragraph is particularly suitable for use in combination with the disclosed wall block having an elongate form.

The wall block according to the invention can be used to construct many types of walls or partitions, the words "wall" and "(walled) partition" being synonymous and the term "wall" in the present application also being intended to include "partitions." Typical examples of walls that can be constructed using the wall block according to the invention are walls of buildings (exterior walls and interior walls), division walls, supporting walls, decorative walls, boundary walls, parapet walls, etc. The use thereof for house walls (exterior walls or interior walls) is cited as particularly prominent. The simple producibility of the wall block according to the invention, even without an industrialized environment, and the extremely simple and rapid construction of walls using wall blocks according to the invention are very advantageous, very particularly in less industrialized environments, in connection with natural disasters and in connection with situations where it is desirable to create solid housing for a large number of people using simple means and as quickly as possible.

The invention further relates to a wall block family containing at least the 14 wall block types listed in the following:

(a1) wall block type, comprising:

(aa) a peripheral wall which surrounds a passage passing from a first seating face to a second seating face of the wall block;

(bb) an extension arrangement on the first seating face and a receiving arrangement on the second seating face;

(cc) a total of exactly one fin, which extends away tangentially from the wall and protrudes parallel on the left to a radial vector of the wall extending away from the center of the wall block; and (dd) a substantially corresponding length and width, if the wall block is viewed as fin-free;

(b1) wall block type which is designed as specified under (aa), (bb) and (dd) for wall block type (a1) and comprises:

(cc) a total of exactly one fin, which extends away tangentially from the wall and protrudes parallel on the right to a radial vector of the wall extending toward the center of the wall block;

(c1) wall block type which is designed as specified under (aa), (bb) and (dd) for wall block type (a1) and comprises:

(cc) a total of exactly two fins, which extend tangentially away from the wall parallel to one another, specifically with one fin protruding parallel on the left and the other fin parallel on the right to a radial vector of the wall extending away from the center of the wall block;

(d1) wall block type which is designed as specified under (aa), (bb) and (dd) for wall block type (a1) and comprises:

(cc) a total of exactly three fins, specifically one fin as specified under (cc) for wall block type (a1) and two opposing fins as specified under (cc) for wall block type (c1);

(e1) wall block type which is designed as specified under (aa), (bb) and (dd) for wall block type (a1) and comprises:

(cc) a total of exactly three fins, specifically one fin as specified under (cc) for wall block type (b1) and two opposing fins as specified under (cc) for wall block type (c1);

(f1) wall block type which is designed as specified under (aa), (bb) and (dd) for wall block type (a1) and comprises:

(cc) a total of exactly four fins, specifically two fins as specified under (cc) for wall block type (c1) and additionally two opposing fins also as specified under (cc) for wall block type (c1);

(g1) wall block which is designed as specified under (aa), (bb) and (dd) for wall block type (a1) and which has a substantially corresponding length and width and is free of one or more fins;

(a2) wall block type, comprising:

(aa) a peripheral wall which surrounds one or more passages passing from a first seating face of the wall block to a second seating face of the wall block;

(bb) on the length of the wall block, two extension arrangements on the first seating face and two receiving arrangements on the second seating face;

(cc) a length that is greater than the width; and (dd) a total of exactly one fin, which extends tangentially away from the wall and protrudes parallel on the left to a vector of the wall extending away from the wall block on the longitudinal central axis of the wall block;

(b2) wall block type which is designed as specified under (aa), (bb) and (cc) for wall block type (a2) and comprises:

(dd) a total of exactly one fin, which extends tangentially away from the wall and protrudes parallel on the right to a vector of the wall extending away from the wall block on the longitudinal central axis of the wall block;

(c2) wall block type which is designed as specified under (aa), (bb) and (cc) for wall block type (a2) and comprises:

(dd) a total of exactly two fins, which extend tangentially away from the wall parallel to one another, specifically which protrude parallel on the left and on the right to a vector of the wall extending away from the wall block on the longitudinal central axis of the wall block;

(d2) wall block type which is designed as specified under (aa), (bb) and (cc) for wall block type (a2) and comprises:

(dd) a total of exactly three fins, specifically one fin as specified under (dd) for wall block type (a2) and two opposing fins as specified under (dd) for wall block type (c2);

(e2) wall block type which is designed as specified under (aa), (bb) and (cc) for wall block type (a2) and comprises:

(dd) a total of exactly three fins, specifically one fin as specified under (dd) for wall block type (b2) and two opposing fins as specified under (dd) for wall block type (c2);

(f2) wall block type which is designed as specified under (aa), (bb) and (cc) for wall block type (a2) and comprises:

(dd) a total of exactly four fins, specifically two fins as specified under (dd) for wall block type (c2) and additionally two opposing fins also as specified under (dd) for wall block type (c2);

(g2) wall block type which is designed as specified under (aa), (bb) and (cc) for wall block type (a2) and is free of one or more fins.

These wall block types are explained in the following in the example part with reference to drawings. At this point, it is emphasized that the wall block types (a2) to (g2) can be designed as has been disclosed above for the wall block according to the invention, i.e. can have one or more of the features disclosed above.

The invention also relates to an assortment of wall blocks which contains wall blocks of at least two different wall block types from the above list (a1) to (g2), but which can also contain other wall block types. In an embodiment, the assortment of wall blocks comprises wall blocks at least of the wall block types (a2), (b2) and (c2).

The invention also relates to a wall, characterized in that it has at least one portion in which wall blocks are installed, as disclosed above as wall blocks according to the invention.

The wall according to the invention can have at least one portion in which claimed wall blocks having at least one passage in each case are present and pockets are present between adjacent end faces of adjacent wall blocks, which passages and/or pockets are filled with material that was pourable in the filling state. A variety of pourable materials can be considered, although a distinction can initially be made between materials that set permanently after filling and materials that do not set substantially permanently after filling. In the case of the last-mentioned materials, walls made of wall blocks according to the invention can be easily dismantled and the dismantled wall blocks can be used to construct new walls. In the case of the first-mentioned materials, it is possible to dismantle the wall blocks only with considerable effort; usually, the dismantled wall blocks can be reused only in part. The above-mentioned filling stabilizes the wall and increases its mass, heat storage capacity, thermal insulation and sound insulation. The pourable material can be, but does not need to be, filled in over the entire wall. Filling primarily at wall regions where there are increased requirements for strength is possible. Concrete is cited as a typical material that sets. Typical materials that do not solidify significantly are soil, clay, sand and gravel. Since the passages and the pockets, in many cases alternating with one another, usually extend from top to bottom in the wall, at least for a plurality of wall block heights, it is easy to set reinforcing bars in the passages and/or pockets and thus arrive at vertical reinforced concrete cores of the wall.

The wall according to the invention, which can have one or more of the features disclosed above, can also be characterized in that it has at least one bend in its longitudinal extension direction, which bend is formed by means of the above-mentioned variable-angle form-fitting engagement of an extension arrangement and a receiving arrangement.

With such bends it is possible to easily produce in particular wall corners of external building walls and wall corners of internal building walls. These corners often have an angle of approximately 90°, although they can also have other angles, as will become clearer below. One possibility that is particularly worth mentioning is to construct an external wall of a house having one or more bends which are mostly within the range of 0° to 45°, in order to follow a non-straight course of a property boundary and thus make optimal use of the property area.

The wall according to the invention, which can have one or more of the features disclosed above, can further have at least one T-cross connection and/or at least one X-cross connection. The wall blocks according to the invention make it possible to produce such connections in a very simple manner, as will become clearer below.

The wall according to the invention, which can have one or more of the features disclosed above, can further have at least one lintel over a wall opening and/or at least one wall anchor extending along the wall, the lintel or the wall anchor containing claimed wall blocks according to the invention filled with concrete. It is particularly favorable for such a wall to use wall blocks that have an integrally formed end plate or a separately inserted end plate, so that concrete can be filled into the relevant wall blocks and does not continue to run away downwards. The use of reinforced concrete, i.e. the insertion of reinforcing bars—usually extending horizontally—in the wall blocks, is advantageous.

The wall according to the invention, which has one or more of the features disclosed above, can further have at least one portion in which claimed wall blocks are placed one on top of the other free of joining material therebetween.

In the traditional construction of walls, blocks or bricks are placed one next to the other in a first, lowermost row, specifically with mortar being introduced between two horizontally adjacent bricks. A second row of bricks is then placed thereon, with a mortar layer being applied between the first row and the second row. The mortar, after hardening, produces a strong bond between two adjacent bricks, giving the wall the required strength. By means of wall blocks according to the invention, it is possible to erect a wall in the traditional way described, i.e. with mortar between adjacent wall blocks. On the other hand, it is an extraordinarily advantageous property of wall blocks according to the invention that the form-fitting engagement between extension arrangements and receiving arrangements, as well as one or more fins on each of the wall blocks, creates such a high force transmission capacity between adjacent wall blocks that in many cases it is possible to erect walls in which the wall blocks are positioned free of joining material therebetween. This does not affect the possibility of working with mortar at locations at which higher forces are applied to the wall. The wall blocks according to the invention can be used to construct walls that meet the "Eurocode 6" standard, which refers to wall strength, even without the mortared joints between the wall blocks.

The invention also relates to a formwork or mold for producing wall blocks according to the invention which have one or more of the features disclosed above, which formwork is characterized in that

- it is composed of a plurality of formwork parts and can be disassembled in order to remove the formwork from the wall block;
- and in that the formwork parts of the formwork include
  - a formwork part or a plurality of formwork parts for forming the first seating face,
  - a formwork part or a plurality of formwork parts for forming the second seating face, and
  - a formwork part or a plurality of formwork parts for forming the lateral surface.

The fact that the formwork is composed of a plurality of formwork parts which can be disassembled in a simple manner also makes it possible to produce a modified formwork very simply by leaving out and/or adding and/or exchanging individual formwork parts and thus to produce wall blocks having different geometries. This will become clearer below in the embodiments.

Individual formwork parts or all of the formwork parts can be inexpensively made of plastics material; alternatively, formwork parts made of metal are possible.

It is possible to design the formwork such that the formwork parts are held together by means of a tension rod or a plurality of tension rods. In this case, two pressure plates can be provided between which the formwork parts are clamped. It is possible to design the formwork parts such that, when assembled, they engage with one another and form a cohesive formwork unit without connecting means or with few connecting means between the formwork parts, by means of the tension rod(s). In this case, disassembling the formwork parts and removing the formwork from the produced wall block are particularly simple.

BRIEF DESCRIPTION OF THE DRAWINGS

The invention is explained in more detail in the following with reference to embodiments shown in drawings. Instead of "wall block made of artificial stone material," for the sake of brevity reference is made throughout simply to "block"; this always means a wall block made of artificial stone material. In the drawings.

DETAILED DESCRIPTION OF THE INVENTION

Figure 1:
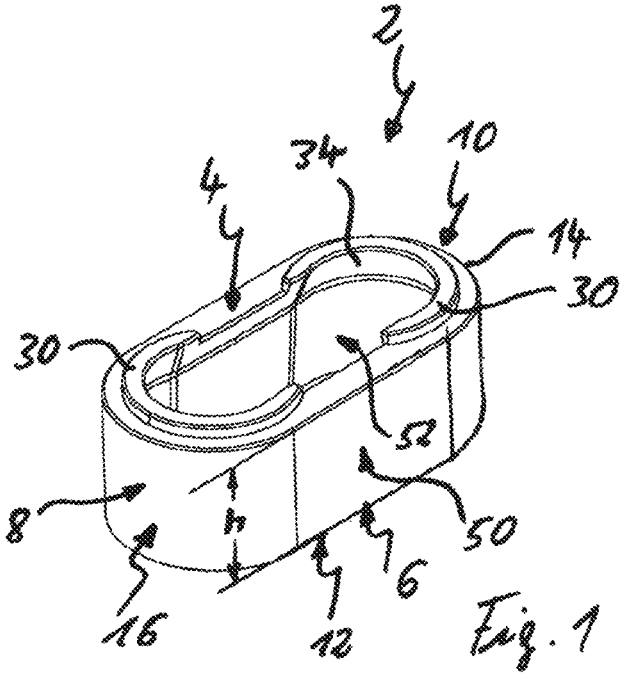
FIG. 1 is a perspective view of a block which, however, does not have a fin/fins, for reasons of clearer and more concise description.
Figure 2:
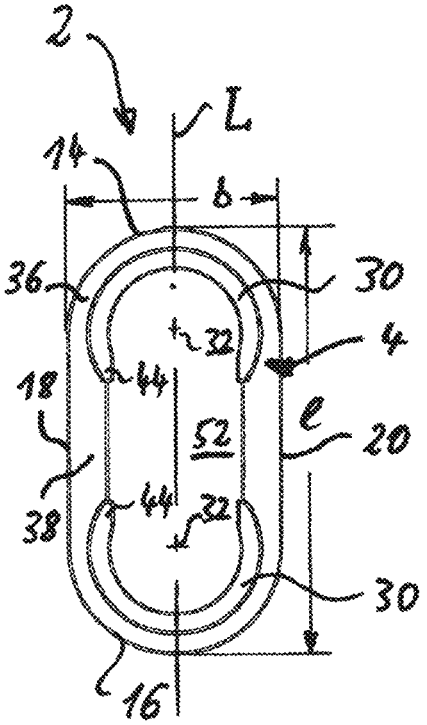
FIG. 2 is a plan view of the first seating face of the block of FIG. 1.
Figure 3:
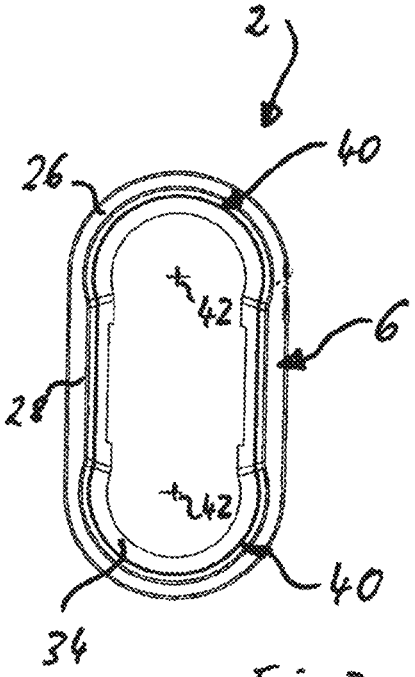
FIG. 3 is a plan view of the opposite second seating face of the block of FIG. 1.

In the block 2 of FIGS. 1 to 3, the longitudinal central axis L is shown, which extends at half the width b and half the height h (measured between a first seating surface 4 and a second seating surface 6). The outer contour or lateral surface 8 of the block 2 is composed—as seen in the plan views of FIGS. 2 and 3—of two semicircles at the block ends and two straight sections therebetween. The side of the block 2 facing upward in FIG. 1 is its first seating face 10, and the side of the block 2 facing downward in FIG. 1 is its second seating face 12. The side of the block 2 (upper semicircle) facing upward in FIG. 2 is its first end face 14, and the side of the block 2 (semicircle) facing downward in FIG. 2 is its second end face 16. The side of the block 2 (straight section) facing left in FIG. 2 is its first wall surface side 18, and the side of the wall block 2 (straight section) facing right in FIG. 2 is its second wall surface side 20.

In the positioning of the block 2 as shown in FIG. 1, its first seating face 10 faces upward and is thus the upper face of the block 2 in the insertion state. In the positioning shown in FIG. 1, the second seating face 12 of the block 2 faces downward, i.e. is the lower face thereof in the insertion state. It is emphasized that the block 2 can alternatively and easily be used "the other way around," i.e. the first seating face 10 as the lower face and the second seating face 12 as the upper face.

The end faces 14 and 16 of the block 2 are intended to each face an end face 14 or 16 of an adjacent block 2 when the block 2 is in the insertion state. However, explanations below will show that there are usage situations in which the end faces 14 and 16 are not adjacent to end faces 14 and 16, respectively, of other blocks 2.

If a wall is erected by means of blocks 2, e.g. in the form of a lowermost, first row of blocks 2, end face 14 or 16 to end face 14 or 16, and a second row of blocks 2 of this kind is placed thereon and several further rows of blocks 2 are further placed thereon, the first wall surface sides 18 are all part of a first wall surface. Correspondingly, the second wall surface sides 20 are part of an opposing second wall surface.

On its first seating face 10, the block 2 has two extension arrangements 30 arranged in a row in the longitudinal direction of the block 2; see FIGS. 1 and 2. On its second seating face 12, the block 2 has two receiving arrangements 40 arranged in a row along the length of the block 2; see FIG. 3. Each extension arrangement 30 is an arched rib which extends over an angular range of approximately 200° and protrudes beyond the remaining first seating face 4 in the height direction. Each receiving arrangement 40 is formed by an arched surface which extends over an angular range of approximately 200° and, for a partial angular range of 180°, extends parallel to the arc of the relevant end face 14 or 16. Each of the extension arrangements 30 is complementary to each of the receiving arrangements 40, i.e. form-fittingly fits into one of the receiving arrangements 40 when a block 2, with its second seating face 12 facing downward, is placed on top of the block 2 of FIG. 1, whether this be without a longitudinal offset of these two blocks 2 or whether this be with a longitudinal offset of these two blocks 2 by a half block length l. The terms "complementary" and "form-fitting" are to be understood as functionally appropriate given the production tolerances that are common in the field of wall blocks. Specifically, this means that the outward facing outer periphery of the arc of the relevant extension arrangement 30 has a slightly smaller radius than the radius of the inward facing arc surface of the relevant receiving arrangement 40, such that the extension arrangement 30 and the receiving arrangement 40 can fit inside one another easily. The reference sign 32 refers—as seen in the plan views of FIGS. 2 and 3—to the center of the relevant extension arrangement; the reference sign 42 refers to the center of the relevant receiving arrangement 40. The centers 32 and 42 each lie on a common line (central axis) which extends in the direction of the height h of the block 2 and intersects the longitudinal central axis L.

The block 2 of FIGS. 1 to 3 is a hollow block which has a peripheral outer wall 50 and—delimited by the wall 50—a passage 52 which extends from the first seating face 10 to the second seating face 12. It is emphasized that the block 2 can have a plurality of passages instead of the single passage 52, which passages each extend from the first seating face 10 to the second seating face 12, e.g. two circular passages having the centers 32 and 42, respectively, and a central connecting part between the two wall regions on the two wall surface sides 18 and 20. It is also emphasized that the block 2 can alternatively be designed as a full block without one or more passages 52. In this case, the receiving arrangements 40 would be formed, for example, as circular 360° recesses in the second seating face 12, and the extension arrangements 30 would be formed, for example, as circular 360° ribs on the first seating face 4.

The regions on the first seating face 10 of the block 2 where there is no extension arrangement 30 and no passage 52 are collectively referred to as the first seating surface 4 of the block 2. The regions on the second seating face 12 of the block where there is no receiving arrangement 40 and no passage 52 are collectively referred to as the second seating surface 6 of the block 2. If a third further block 2, with its second seating face 12 facing downward, is placed on top of the block 2 of FIG. 1 (whether this be without a longitudinal offset or whether this be with a longitudinal offset by half a block length l), the entirety (if placed without a longitudinal offset) or slightly less than half (if placed with a longitudinal offset by half a block length l) of the second seating surface 6 of the upper block 2 sits on the first seating surface 4 of the lower block 2. The upper face of the relevant extension arrangement 30 does not abut any counter-surface on the lower seating face 12 of the upper block 2. If the block 2 is designed for use with mortar between the lower block 2 and the upper block 2, the extension arrangements 30 are each designed with a height and the receiving arrangements 40 are each designed with a height dimension such that the described form-fitting engagement between the relevant extension arrangement 30 and the relevant receiving arrangement 40 takes place despite the interposed mortar.

The length l of the block 2 is measured from the center of the first end face 14 to the center of the first end face 16. The width b of the block 2 is measured between the center of the first wall surface side 18 and the center of the second wall surface side 20. Insofar as, unlike in the drawn embodiment, the outer lateral surface is not at a right angle to the first seating surface 22 and the second seating surface 24, the length l and the width b are measured at the largest point in each case. The height h of the block 2 is measured from the first seating surface 4 to the second seating surface 6. In this embodiment, the block 2 of FIGS. 1 to 3 has a spacing between the two centers 32 or between the two centers 42 of 250 mm, a length l of 495 mm, a width b of 245 mm, and a height h of 175 mm. Said real length and said real width are slightly smaller than the nominal length of 500 mm and the nominal width of 250 mm, in order to be able to work easily in light of the production tolerances when joining blocks 2. Considering the nominal dimensions, the block 2 is twice as long as it is wide and the spacing of the two centers 32 or the two centers 42 is half as large as the block length. Considering the real dimensions, this statement applies with "substantially."

The block 2 of FIGS. 1 to 3 is mirror-symmetrical with respect to its longitudinal central plane and is mirror-symmetrical with respect to its transverse central plane.

It is emphasized that the block 2 can alternatively have a length l that is significantly greater than twice the width b. By way of example, reference is made to a block 2 in which the length l is four times the width b. It is also emphasized that the block 2 can alternatively have more than two extension arrangements 30 and more than two receiving arrangements 40, in a row in each case. For a block 2 of which the length l is four times the width b, it is possible to provide e.g. four extension arrangements 30 and four receiving arrangements 40, each in a row, and e.g. four continuous passages 52. Blocks 2 which have two extension arrangements 30 and two receiving arrangements 40 and a length l that substantially corresponds to twice the spacing of the two centers 32 or the two centers 42, can nevertheless be used in a particularly favorable and varied manner in the construction of walls. In this case, the width b can certainly be slightly larger or slightly smaller than half the block length l.

If a wall is constructed using a plurality of blocks 2 of FIGS. 1 to 3 in the manner described, the first wall surface and the second wall surface are surfaces which are closed as a whole and pass through in an almost completely planar manner. There is a small gap-like recess in each row of bricks where the end face 14 or 16 is positioned against the end face 14 or 16; however, this is very small and of very shallow depth.

With the blocks 2 of FIGS. 1 to 3, it is not only possible to construct straight walls, but it is also possible to build a wall bend in the bending range of 0 to 90°, even beyond, in the simplest manner. The extension arrangements 30 and the receiving arrangements 40 are designed in such a way that the construction of bends of the wall is possible even if there is a longitudinal offset by half a block length l from one row of blocks to the next.

Since each extension arrangement 30 and each receiving arrangement 40 extend over an angular range of more than 180°, the mentioned form-fitting engagement between a relevant extension arrangement 30 and a relevant receiving arrangement 40 is effective not only against forces acting transversely to the wall, but also against forces acting in both longitudinal directions of the wall (highly tensile clamping in the longitudinal direction of the wall). However, when the upper block 2 is placed thereon with an angle between the longitudinal central axes L of the lower block 2 and the upper block 2 of more than approximately 45°, said form-fitting engagement is no longer effective in all horizontal directions, but is effective in some of the horizontal directions.

As can be seen in the top view of the second seating face 12 of the block in FIG. 3, the second seating face 6 is composed substantially of two semicircular strips 26 on the outside along the receiving arrangements 40 and two substantially straight strips 28 therebetween. The straight strips 28—measured in the direction of the width b—have a greater width than the semicircular strips 26.

When progressing in the passage 52 from the second seating face 12 to the first seating face 10 of the block, the cross-sectional area of the passage 52 progressively decreases slightly, and this sloping allows the separation of the block 2 from the formwork by means of which it has been produced. Approaching the first seating face 10 in said progression in the passage 52, the passage 52 has a greater slope 34 all round toward the interior of the passage 52. The extent of this greater slope 34 is selected such that the width of the two substantially semicircular strips 36 of the first seating surface 4 is substantially equal to the width of the semicircular strips 26 on the second seating surface 6. The straight strips 38 of the first seating surface 4 are wider between the ends of the two extension arrangements 30—measured in the width direction of the block 2—than the straight strips 28 on the second seating surface 6. This increases the stability of the block 2 and produces a better connection of the four end regions 44 of the two extension arrangements 30 to the wall 50 of the block 2.

Instead of forming each of the extension arrangements 30 as a continuous arched rib, for example a plurality of segments of a rib could be provided so as to provide interrupted arched form-fitting engagement with the relevant receiving arrangement 40. Functionally, there would then be a kind of arched envelope along the parts of the relevant rib.

FIGS. 4 to 9 show further embodiments of blocks 2 according to the invention, which can be understood most clearly as modifications of the block 2 of FIGS. 1 to 3 by providing fins 60.

Figures 4, 5, 6, 7, 8, 9:
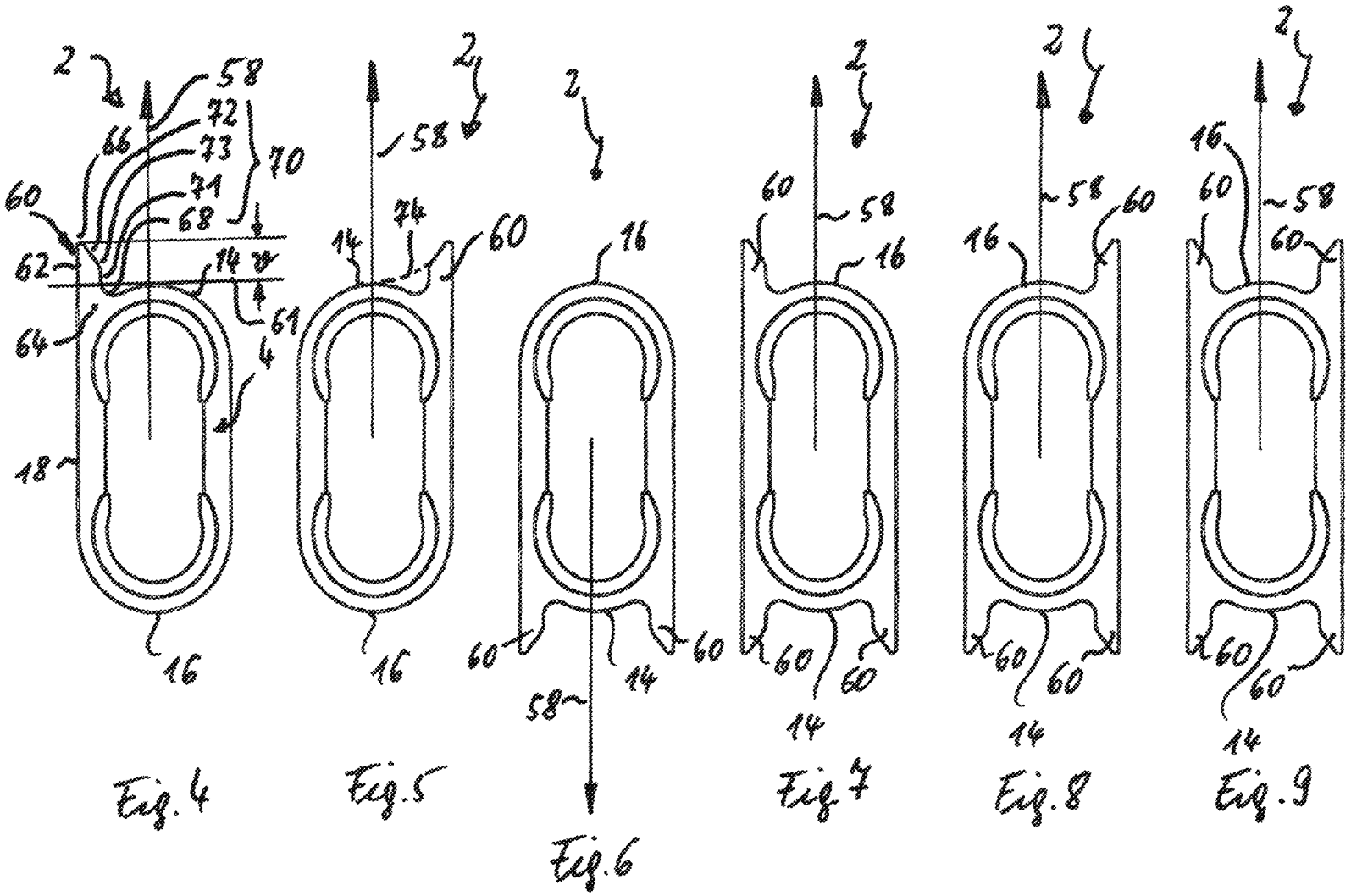
FIGS. 4 to 9 show six further embodiments of a block, in each case in plan view of the first seating face.

In FIG. 4, the block 2 has a single fin 60 located at the transition between the first end face 14 and the first wall surface side 18. The main extension direction of the fin 60 is from bottom to top in FIG. 4, such that the outer surface 62 of the fin 60 continues the first wall surface side 18 of the block 2. Proceeding from the root 64 of the fin 60 (where it extends away from the rest of the block 2) to the free end 66 of the fin 60, the inner surface 70 of the fin 60 is composed of the following portions in this order: an outwardly concave rounding 68, a straight portion 71 parallel to the outer surface 62 of the fin 60, an outwardly convex transition portion 73, and an outwardly concave rounded portion 72. This portion 72 is part of a virtual semicircle which extends at a narrow spacing parallel to a fin-free first end face 14 of an adjacently placed block 2. The fin 60 then ends with a relatively small dimension between the outer face 62 and the inner face 70. The radius of the outwardly convex rounding 72 is substantially as great as the radius of the rounded portion on the end faces 14 and 16. The outwardly concave rounding 68 near the root 64 of the fin 60 has a significantly smaller radius. The width of the fins between their outer face 62 and the part of their inner face 70 that is parallel to their outer face 62 is slightly smaller than the width of the straight portion 38 of the first seating surface 22.

The extent v of protrusion of the fin 60 beyond a virtual flat surface 61, which is located at the center of the first end face 14 at a right angle to the longitudinal central axis L, is smaller than the spacing between the center of the first end face 14 and the center 32 of the extension arrangement 30 which is nearest to the fin 60 and is at the top in FIG. 4. In the embodiment in FIG. 4, the extent of protrusion v is approximately half the last-mentioned spacing.

FIGS. 4 to 9 each show a vector 58 which extends on the longitudinal central axis L of the relevant block 2 and, from the center of the block, is directed away from the block 2. In FIG. 4, the fin 60 extends in parallel on the left to the vector 58.

The block 2 of FIG. 5 differs from the block 2 of FIG. 4 in that it has a single fin 60, but now in mirror inversion at the other transition between the first end face 14 and the second wall surface side 20. The fin 60 extends in parallel on the right to the vector 58.

The block 2 of FIG. 6 has exactly two fins 60 on its second end face 16, in each case at the transition to the first wall surface side 18 and the second wall surface side 20, respectively. The fins 60 extend in parallel to one another and parallel on the left and parallel on the right to the vector 58.

The block 2 of FIG. 7 has exactly three fins 60, one as in the block 2 of FIG. 4 and two as in the block of FIG. 6.

The block 2 of FIG. 8 has exactly three fins 60, one as in the block of FIG. 5 and two as in the block of FIG. 6.

The block 2 of FIG. 9 has exactly four fins 60, two protruding downward in FIG. 9 as in FIG. 6 and two protruding upward in mirror inversion in FIG. 9.

In all of FIGS. 4 to 9, the fins 60 have the same design (although mirror-inverted in some cases) and the same dimensions. The statements made on the design and dimensions of the fin 60 in connection with FIG. 4 also apply analogously to FIGS. 5 to 9.

Figure 10:
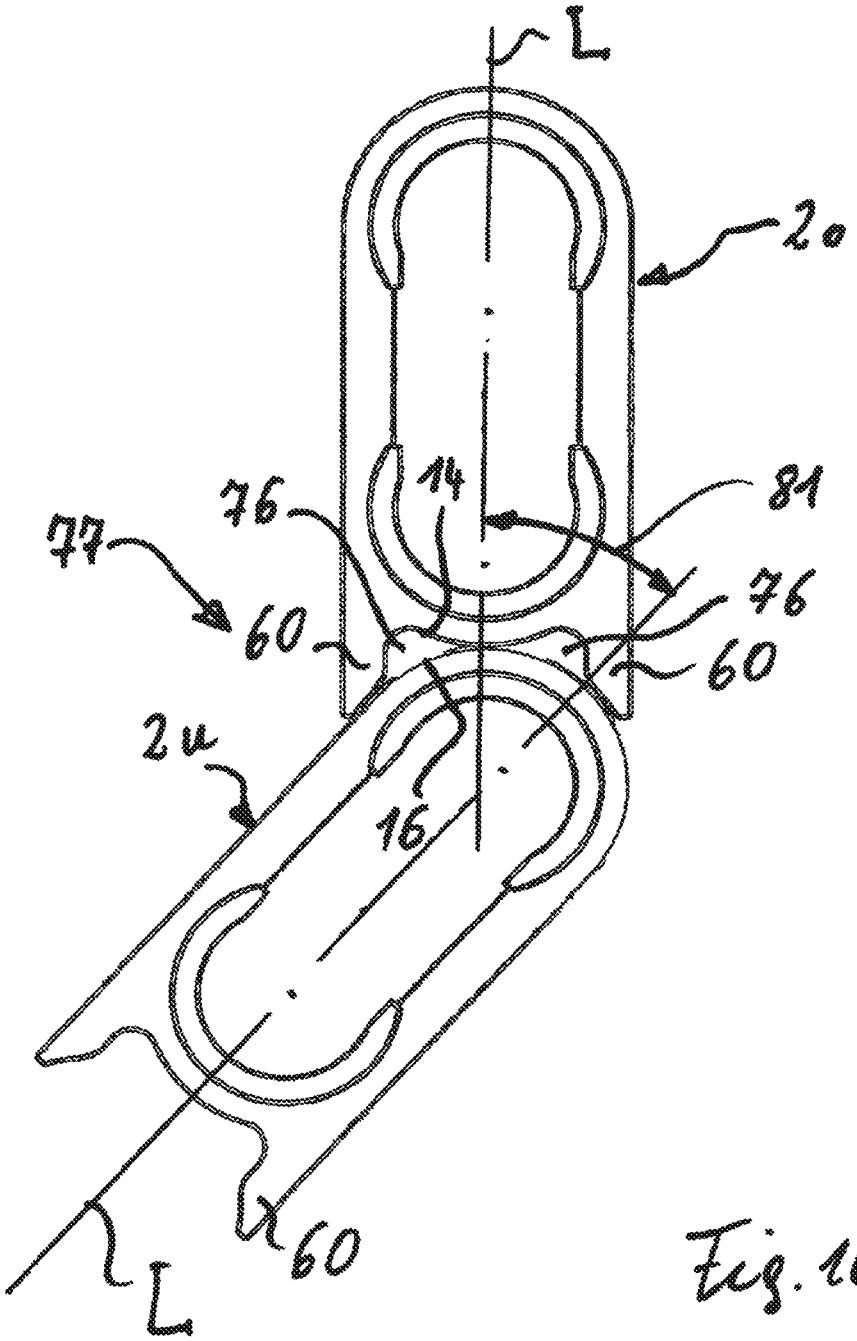
FIG. 10 shows two blocks of FIG. 6, placed against one another end face to end face, in a plan view of the first seating faces.

In FIG. 10 two blocks 2, each having a first end face 14 with two fins 60 and an overall semicircularly rounded second end face 18, are placed one on top of the other. FIG. 10 shows that the geometry of the fins 60 makes it possible for the block 2*u* positioned at the bottom in FIG. 10 to be pivoted relative to the further block 2*o* shown at the top of FIG. 10 up to an angle of somewhat more than 45° between the longitudinal central axes L of the two blocks 2, seen in plan view of the first seating faces 10 or the second seating faces 12 of the blocks 2, without the end 66 of the fin 60, which is located on the inner face of the bend 77 or kink 77 of the row of blocks, reaching the point of transition between the overall semicircularly rounded second end face 16 of the lower block 2*u* and the flat second wall surface side 20 of the lower block 2*u*. Shortly after this transition point 79 is reached, further pivoting of the lower block 2*u* is possible only "at the cost" of the blocks 20 and 2*u* moving apart from one another so as to create a gap between the first end face 14 of the upper block 20 and the second end face 16 of the lower block 2*u*. However, such moving apart is made impossible if a third further block 2 is placed on the shown blocks 2*o* and 2*u* in such a way that its longitudinal central axis L is parallel to the longitudinal central axis of the block 2*o*, that its two receiving arrangements 40 are in form-fitting engagement with the extension arrangement 30, at the bottom in FIG. 10, of the upper block 2*o* and the extension arrangement 30, at the top in FIG. 10, of the lower block 2*u*, and that the placed third further block 2 is oriented with its two fins 60 pointing upward in FIG. 10. The same applies if a fourth further block 2 is placed below the shown blocks 2*o* and 2*u*, the extension arrangements 30 of which further block are in form-fitting engagement with two receiving arrangements 40 of the blocks 20 and 2*u*.

FIG. 10 clearly shows that the extent of protrusion v of the fins 60 determines the magnitude of the pivot angle 81 that is maximally possible before the described gap between the two adjacent blocks 2 is formed. The shorter the fins 60, the greater the maximum pivot angle. It can also be clearly seen in FIG. 10 that the maximum pivot angle 81 even exceeds 90° (in this case specifically approximately 100°) if the upper block 2*o* is formed without the fin 60 on the left in FIG. 10.

FIG. 10 also shows that the shape of the fins 60 described in detail in connection with FIG. 4 represents a recess of the first end face 14 of the block 2 toward the block 2 in comparison with a virtual arc 74, which is shown in FIG. 5 for illustrative purposes. This virtual arc 74 begins in the center of the first end face 14 and extends to the end 66 of the relevant fin 60. Due to being set back as described, in FIG. 10 a pocket 76 is created next to each fin 60 between the upper block 2*o* and the lower block 2*u*. The advantages of the pockets 76 are explained in more detail below.

FIGS. 11 to 14 show an arrangement of three blocks 2, specifically two blocks 2 as part of a lower row of blocks end face to end face and a further block as part of a second row of blocks placed thereon. The last-mentioned block 2 is placed with a longitudinal offset by half a block length l and thus links the two blocks 2 of the lower row of blocks. All three blocks 2 are blocks 2 according to FIG. 6 or FIG. 10, i.e. having two fins 60 on the first end face 14 in each case and an overall semicircularly rounded second end face 16. The fins 60 are oriented in the same direction in all the blocks 2, i.e. are directed to the upper left in FIG. 11 and to the left in FIG. 12.

Figure 14:
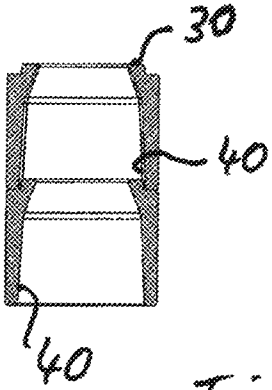
FIG. 14 shows the arrangement of the blocks of FIG. 11 in a cross-section along D-D in FIG. 12.
Figure 13:
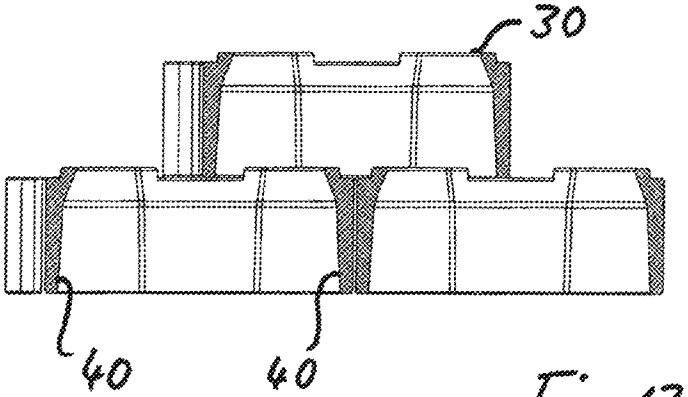
FIG. 13 shows the arrangement of the blocks of FIG. 11 in a longitudinal section along C-C in FIG. 12.

The sections of FIGS. 13 and 14 show very clearly what has already been described above in connection with FIGS. 1 to 3. The two adjacent extension arrangements 30 of the two lower blocks 2 sit form-fittingly in the two receiving arrangements 40 of the upper block 2.

Figure 12:
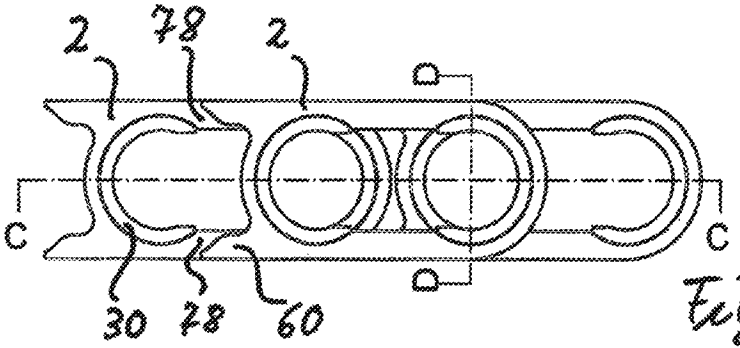
FIG. 12 shows the block arrangement of FIG. 11 in a plan view of the first seating faces of the blocks.

In FIG. 12, it can be seen that the left, lower block 2 can be pivoted relative to the right, lower block 2 and thus also relative to the upper block 2 at most by a relatively small angle (between the longitudinal central axes L of the right, lower block and the upper block 2 on the one hand and the longitudinal central axes L of the left, lower block 2 on the other hand). The maximum pivotability is achieved when an end region of the left extension arrangement 30, visible in FIG. 12, of the left, lower block 2 abuts one of the two fins 60 of the upper block 2.

Nevertheless, this pivotability disappears when a further block 2 of the upper row of blocks is placed to the left of the upper block 2. A semicircularly rounded region of the peripheral wall 50 of the further block 2 then comes with its lower end region into the two gaps 78, each between an end region of the left extension arrangement 30 of the left lower block 2 and the outwardly concave region 72 of the relevant fin 60. The result is that a wall constructed in this way from the described blocks 2 is rigid against bending; even without the use of mortar, the wall behaves substantially as though it were constructed from the blocks 2 with mortar.

Figure 11:
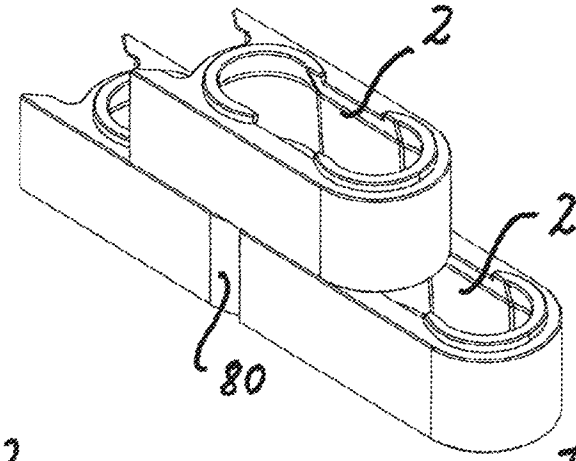
FIG. 11 is a perspective view of three blocks of FIG. 6, consisting of two blocks in a lower row of blocks and one block of a second row of blocks placed on top.

FIG. 11 also shows that due to the fins 60, the gaps 80 between two adjacent blocks 2 in the row of blocks are much smaller than for blocks 2 without fins 60.

Figure 15:
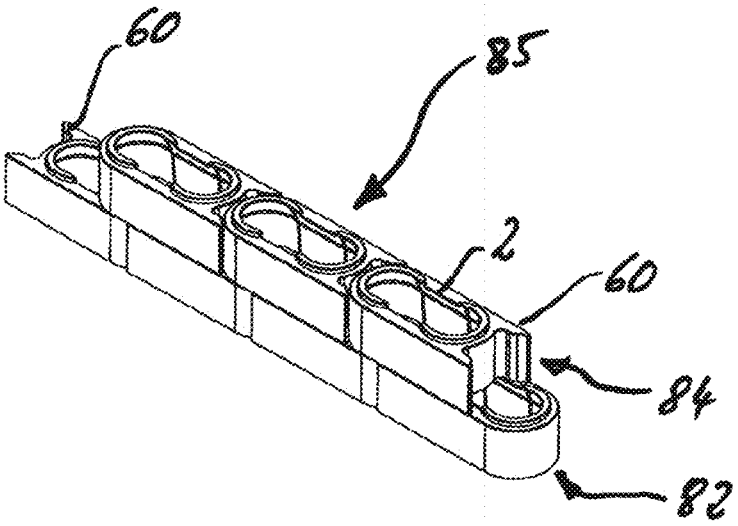
FIG. 15 is a perspective view of an arrangement of seven blocks according to FIG. 6, of which four blocks are in a lower, first row of blocks and three blocks are in a second row of blocks placed thereon.
Figure 16:
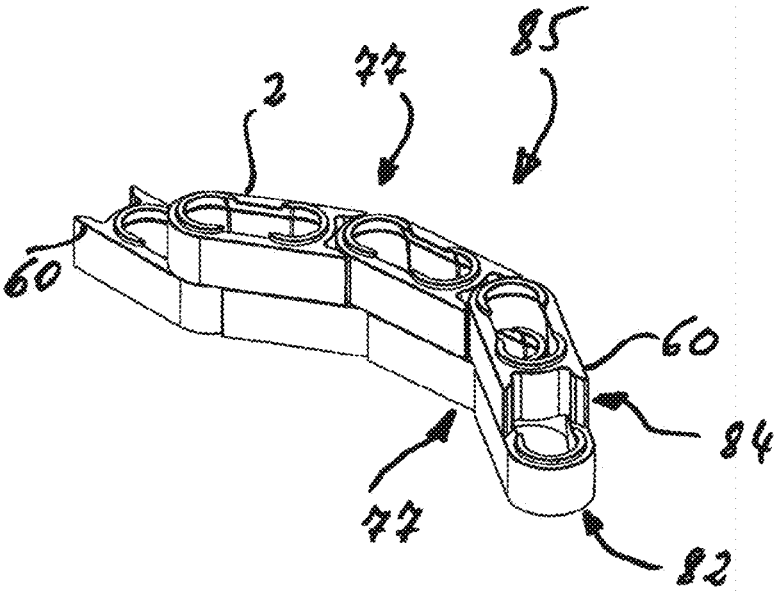
FIG. 16 is a perspective view of the blocks of FIG. 15, but now with the rows of blocks bent several times.

In the embodiment of FIGS. 15 and 16, the blocks 2 of the first, lower row of blocks 82 are oriented with their fins 60 in a first direction (toward the top left in FIG. 15), whereas the blocks 2 in the second row of blocks 84 placed thereon are all oriented in the opposite direction (toward the bottom right in FIG. 15).

FIG. 16 demonstrates that, despite the fact that each block 2 of the upper row of blocks 84 links two blocks 2 of the lower row of blocks 82, walls 85 can be constructed with one or more bends 77 in the longitudinal direction thereof. Specifically, bends 77 are possible where extension arrangements 30 and receiving arrangements 40 are in form-fitting engagement with one another adjacent to end faces 14 and 16, respectively, without fins 60 there. For this purpose, attention is drawn to the right (second) end face 16 of the leftmost block 2 in the lower row 82 of blocks and the left (second) end face 16 of the leftmost block 2 in the upper row 84 of blocks in FIG. 16. The relevant block ends of the two blocks 2 involved there are free of fins 60. Bends 77 are possible in both pivoting directions.

In the embodiment of FIGS. 15 and 16, the bend 77 in the longitudinal extension direction of the wall 85 is limited to slightly more than 45° as a maximum value, as described with reference to FIG. 10.

Considering FIG. 16 as a total of eight wall bends by 45°, all in the same pivot direction, the result is an annularly closed wall polygon. If working instead with blocks 2 according to FIG. 4 (i.e. having only one fin 60) and/or with blocks 2 according to FIG. 5 (i.e. having only one fin 60), it is possible to construct annular closed wall polygons having six corners (angled by 60°) or having four corners (angled by 90°). The described wall polygons can be used as a type of column. It is even possible to completely fill the interior of the polygon with pourable material, in particular concrete, in order to construct a column. The wall polygon thus serves as a kind of formwork for this column.

At this point, it is emphasized that, if desired, walls can also be constructed from two parallel wall block row stacks placed closely together. At desired points of this "double wall," links can be created between the two wall block row stacks using connecting blocks placed at right angles to the wall face sides.

At this point, it is further emphasized that it is also possible to work with blocks in multiple widths, in particular in two widths. The blocks of greater width are used for thicker walls, and the blocks of smaller width are used for thinner walls. The transition between the thicker and thinner walls can be produced using the transition block mentioned above (wider at one end face than at the other end face).

Figure 17:
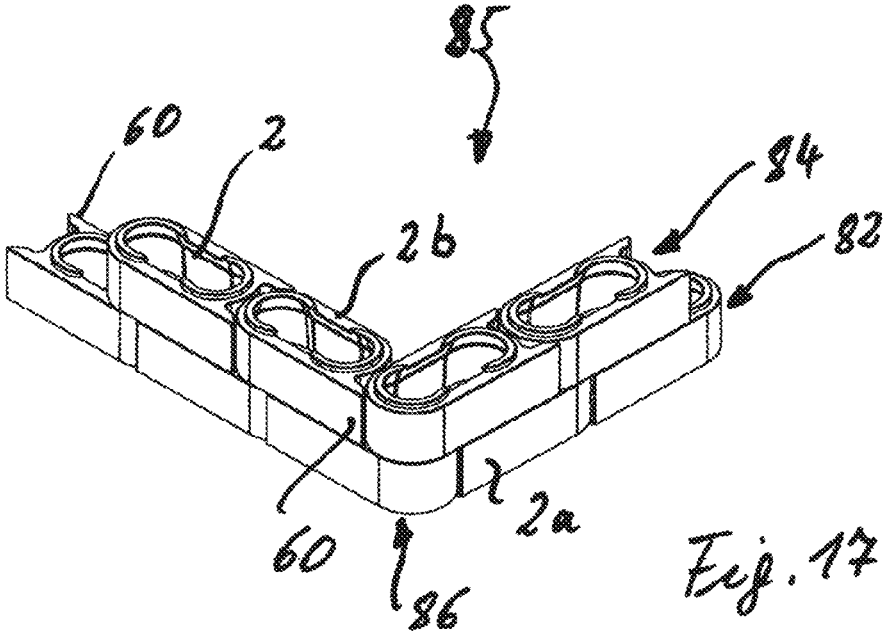
FIG. 17 is a perspective view of an arrangement of nine blocks, specifically five blocks in a lower, first row of blocks and four blocks in a second row of blocks placed thereon.

FIG. 17 shows how the blocks 2 according to the invention can be used to construct a wall corner 86 between two wall portions when the measured inner angle of the wall corner 86 is smaller than approximately 135°. Specifically, the interior angler corner has an internal angle of 90° in the case shown. However, even internal angles that are slightly smaller than 90° are possible.

In the first, lower row 82 of blocks there is, adjacent on the right to the corner 86 in FIG. 17, a block 2*a*, which is designed as shown in FIG. 4. In the second, upper row 84 of blocks there is, adjacent on the left to the corner 86 in FIG. 17, a block 2*b*, which is designed as shown in FIG. 5. In comparison with the other shown blocks 2, which are designed as shown in FIG. 6, the blocks 2*a* and 2*b* do not have the fin 60 which would be located on the inner face of the wall corner 86.

Figure 18:
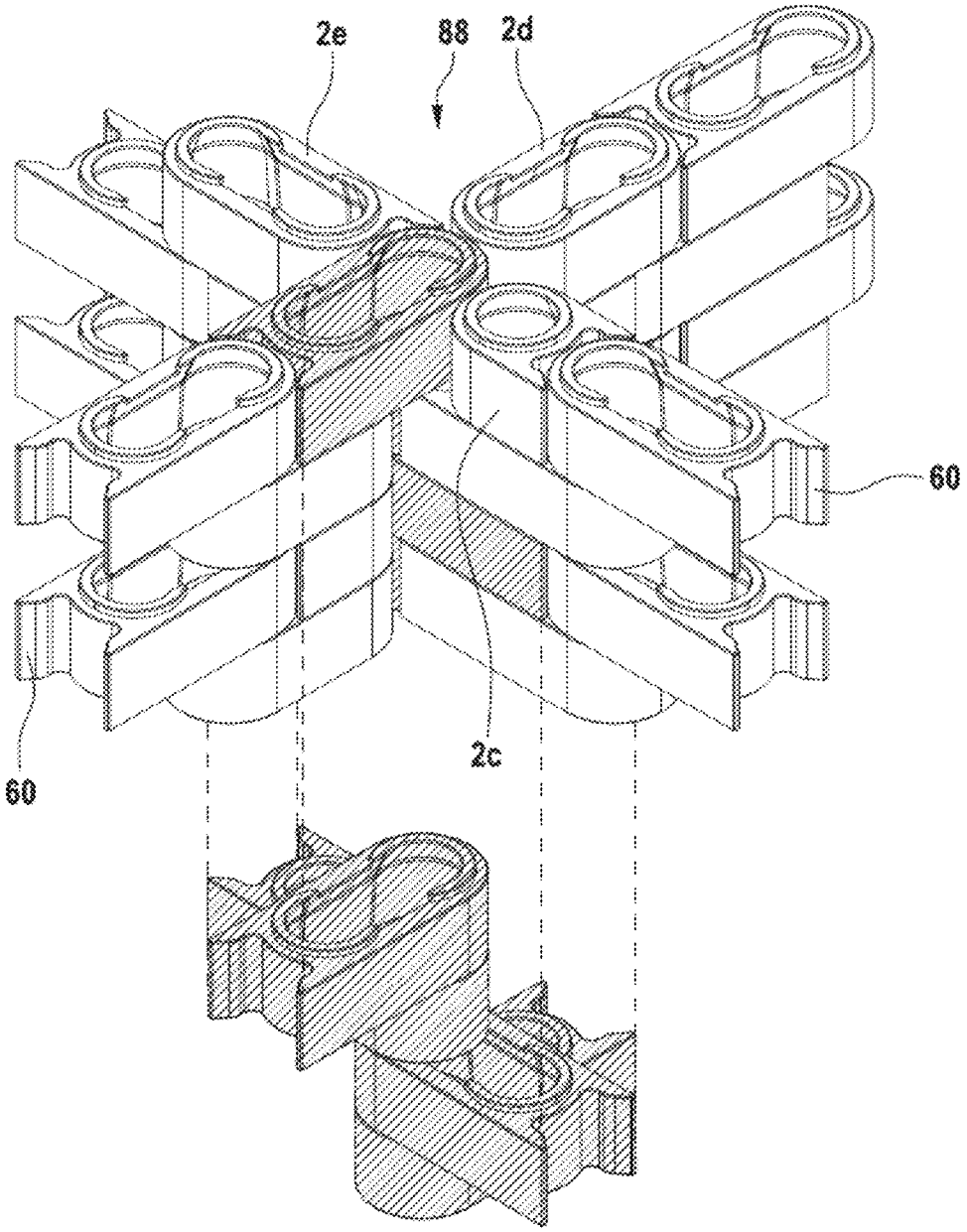
FIG. 18 is a perspective view of a detail of an X-cross of a wall.
Figure 19:
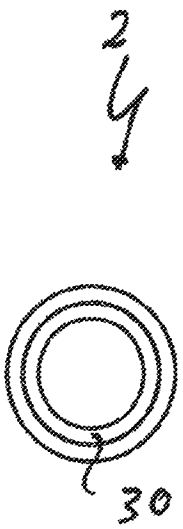
FIGS. 19 to 25 show seven further embodiments of a block, in each case in plan view of the first seating face.
Figure 20:
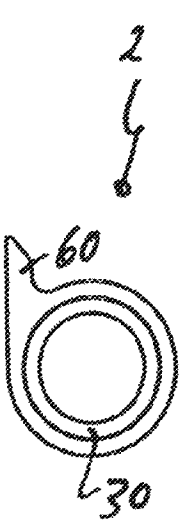
Figure 21:
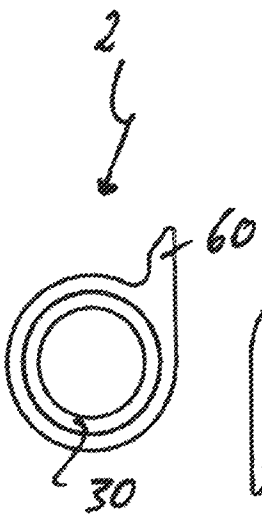
Figure 22:
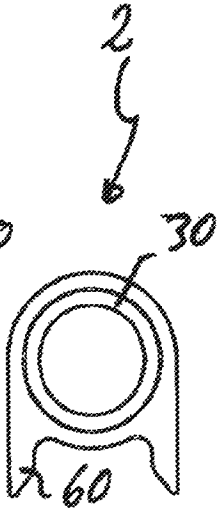
Figure 23:
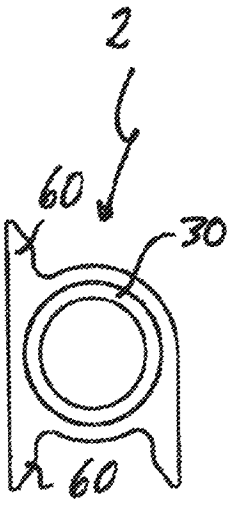
Figure 24:
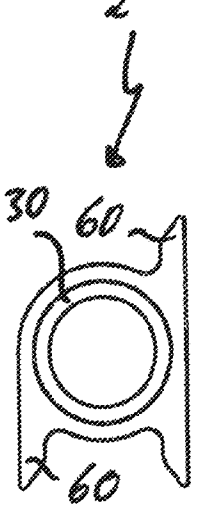
Figure 25:
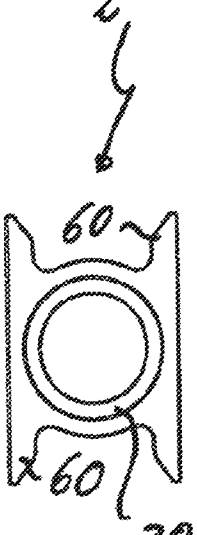

FIG. 18 shows an X-cross 88 of two walls which can be made using blocks 2 disclosed in this application. In the fourth, uppermost block level shown in FIG. 18, a block 2*c* according to FIG. 22 is inserted immediately to the lower right of the X-cross 88. It is also possible to see in the uppermost block level a block 2*d*, which is designed as shown in FIGS. 1 to 3, and a block 2*e*, which is designed as shown in FIG. 4. The lower half of FIG. 18 is a hatched illustration of the four blocks 2 which are involved in connecting the wall portion to the center of the X-cross 88. It is clear that the four wall portions involved are so well connected to the center of the X-cross 88 that considerable forces can be transmitted there. The embodiment in FIG. 18 can be easily reconfigured into a T-cross of three wall portions. In this case, for example, the wall portion extending away to the upper right is not present. Instead of the lowermost integration block 2 in the lower part of FIG. 18, a block 2 is inserted there that does not extend out of the T-cross to the top right.

FIGS. 19 to 25 show seven embodiments of blocks 2 which, which respect to the absence of a fin 60 or with respect to the presence of a fin 60 or a plurality of fins 60, are constructed as shown in FIGS. 1 to 3 and 4 to 9, although now for blocks 2 which have only exactly one extension arrangement 30 and one receiving arrangement 40 and in which the length l is equal to the width b. The single extension arrangement 30 and the single receiving arrangement 40 are each circular over 360°.

The seven blocks 2 of FIGS. 19 to 25 correspond to the wall block types (g1) and (a1) to (f1), as discussed in the general part of the description. The seven blocks 2 of FIGS. 1 to 3 and 4 to 9 correspond to the wall block types (g2) and (a2) to (f2), as discussed in the general part of the description.

The seven blocks 2 of FIGS. 1 to 3 and 4 to 9 on the one hand and the seven blocks 2 of FIGS. 19 to 25 on the other hand belong to a wall block family, as discussed in the general part of the description.

Figure 26:
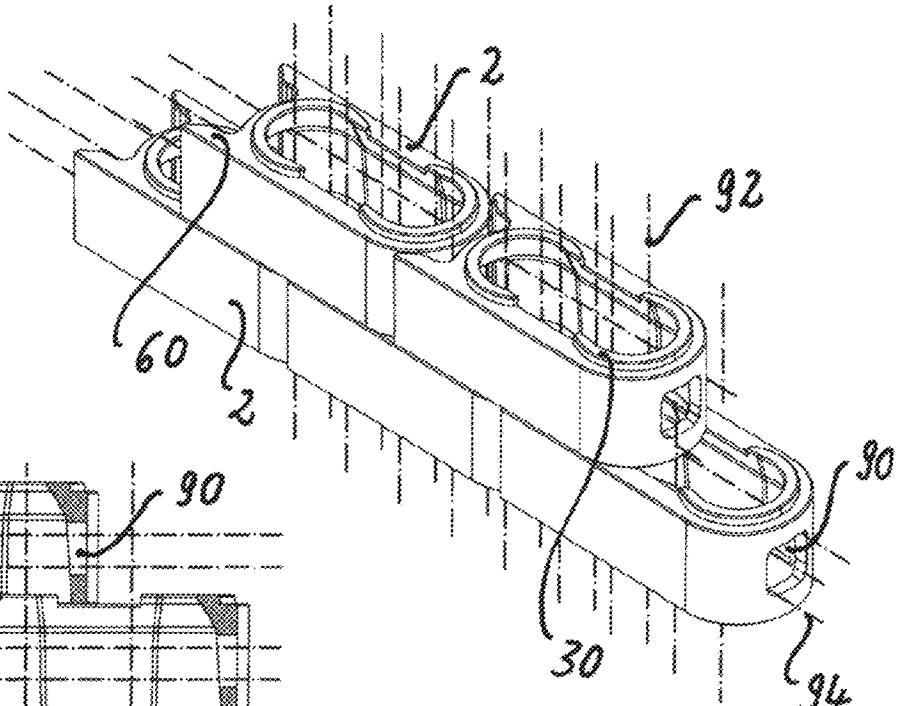
FIG. 26 is a perspective view of a detail of a wall which is erected using blocks according to a further embodiment.
Figure 28:
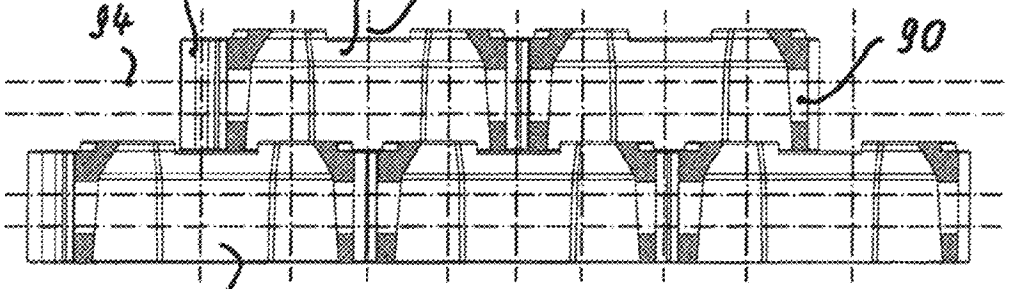
FIG. 28 is a longitudinal section of the wall detail of FIG. 26.
Figure 27:
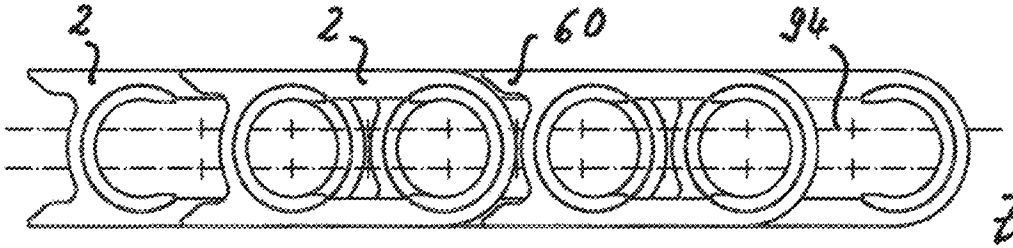
FIG. 27 is a plan view of the wall detail of FIG. 26.

FIG. 26 shows blocks 2 which are blocks 2 according to FIG. 6 in terms of basic design, but have an opening 90 in each of the two end faces 14 and 16 that is delimited all around.

Dotted lines 92 indicate vertical reinforcing bars 92 and dotted lines 94 indicate horizontal reinforcing bars 94. The horizontal reinforcing bars 94 each extend in the longitudinal direction through a plurality of blocks 2 and the openings 90 thereof. The vertical reinforcing bars 92 extend vertically through a plurality of block levels, specifically into the interiors of the extension arrangements 30 and the receiving arrangements 40 and into the pockets 76. Since there is a passage 52 below each pocket 76 and above each pocket 76 in the next block level, the vertical reinforcing bars 92 can pass through a greater number of block levels without complication. The horizontal reinforcing bars 94 are most expediently inserted gradually, following the progress of the construction of the wall. Lateral "threading" of the blocks 2 on ready-placed horizontal reinforcing bars 94 is also possible.

As soon as the reinforcing bars 92 and 94 are in place, all the passages 52 and all the pockets 76 can be filled with flowable concrete. It goes without saying that it is not necessary to make the described reinforcements or fill with concrete as described throughout an entire wall, but this can be limited to particularly heavily loaded wall portions or wall parts. Wall corners, for example, are good candidates for reinforcements and filling with concrete.

It is emphasized that alternatively it is possible to work with blocks 2 without openings 90 and introduce only vertical reinforcing bars 92, or to work with blocks 2 having openings 90 but still introduce only vertical reinforcing bars 92. Attention is also drawn to the possibility of working without reinforcing bars 92 and/or 94 and still filling the passages 52 and the pockets 76 with flowable concrete.

The previous paragraphs have consistently referred to filling with concrete; however, it is emphasized that other pourable materials, as have been disclosed in the general part of the description, can be used instead of concrete. The reinforcing bars disclosed are usually structural steel bars of the type commonly used for constructing structures made of concrete.

Figure 29:
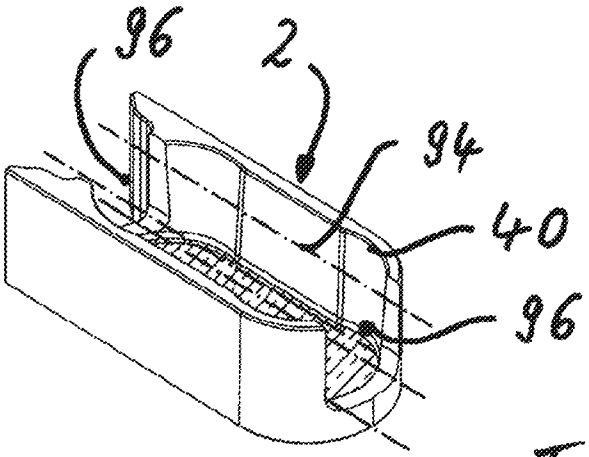
FIG. 29 is a perspective view of a further embodiment of a block.
Figure 32:
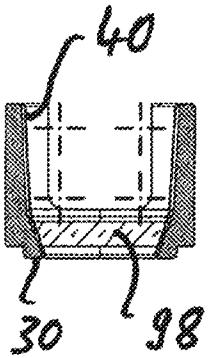
FIG. 32 shows the block of FIGS. 29 and 30 in a cross-section along K-K in FIG. 30.
Figure 30:
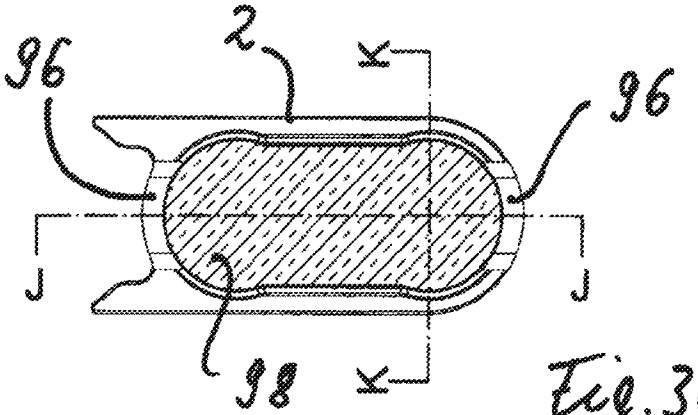
FIG. 30 is a plan view of the block of FIG. 29.
Figure 31:
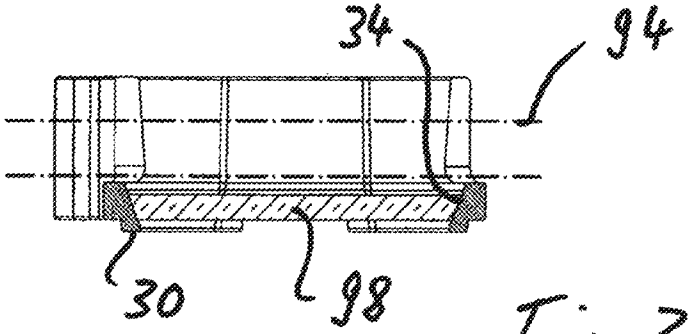
FIG. 31 shows the block of FIGS. 29 and 30 in a longitudinal section along J-J in FIG. 30.

FIG. 29 shows a block 2 which has openings 96 in its two end faces 14 and 16 that are open toward its second seating face 6 and which is provided near its first seating face 4 with an integrally formed end plate or a separately inserted end plate 98, e.g. made of concrete or stone or metal or plastics material. The end plate 98 can be easily inserted, since the passage 52 decreases in its inner surface area as it approaches the first seating face 4, as can be clearly seen in FIGS. 31 and 32.

Figure 34:
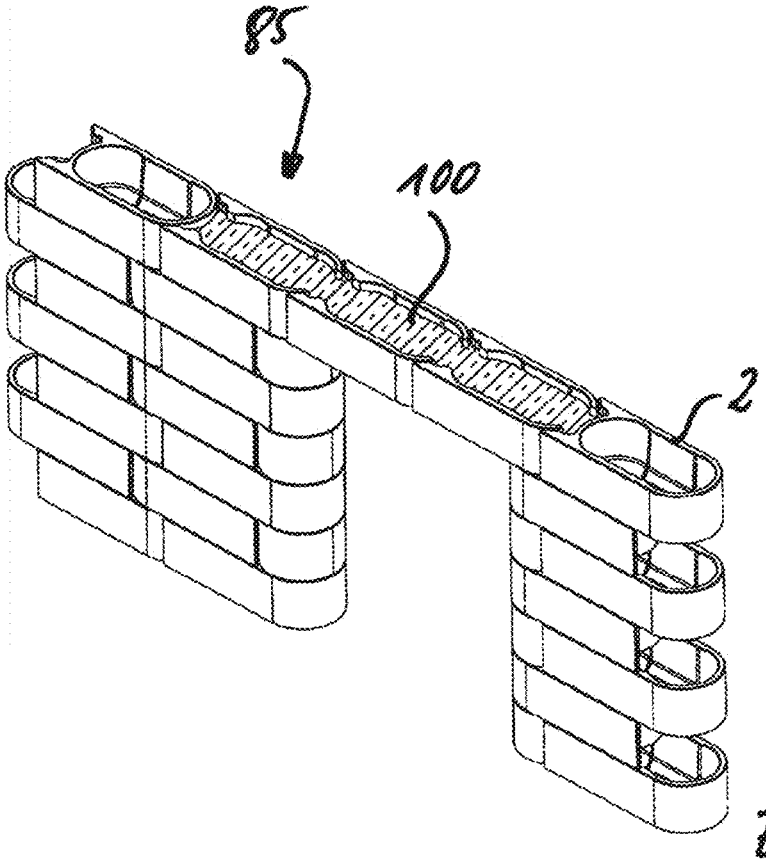
FIG. 34 is a perspective view of a detail of a wall which has been erected using blocks according to the invention.
Figure 36:
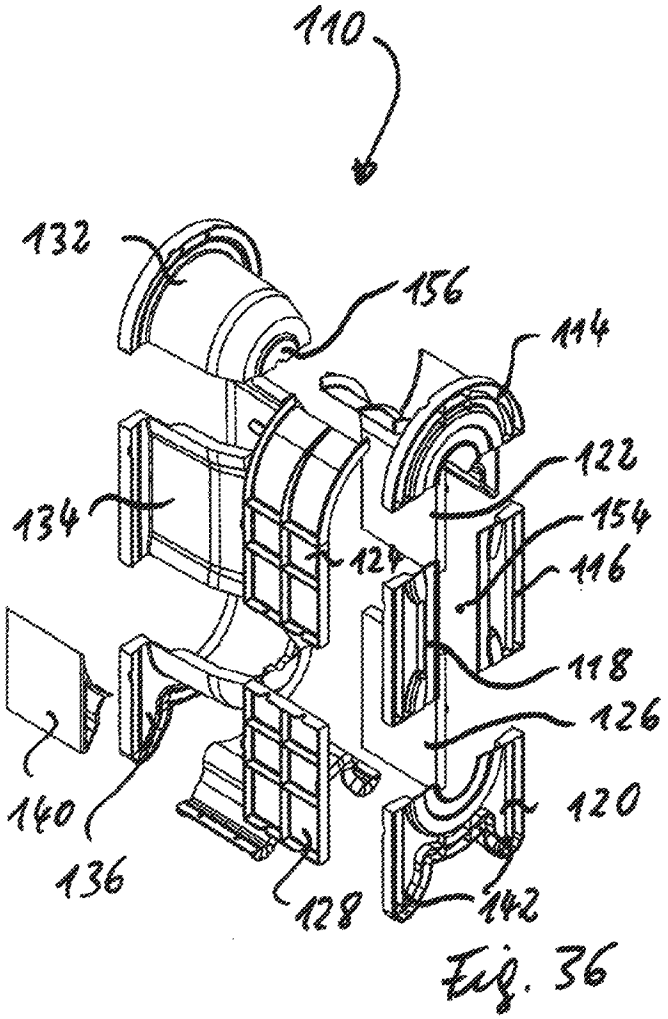
FIG. 36 is a perspective exploded view of the formwork of FIG. 35, the formwork parts that form the first seating face of the wall block with the extension arrangements being closer to the viewer.
Figure 35:
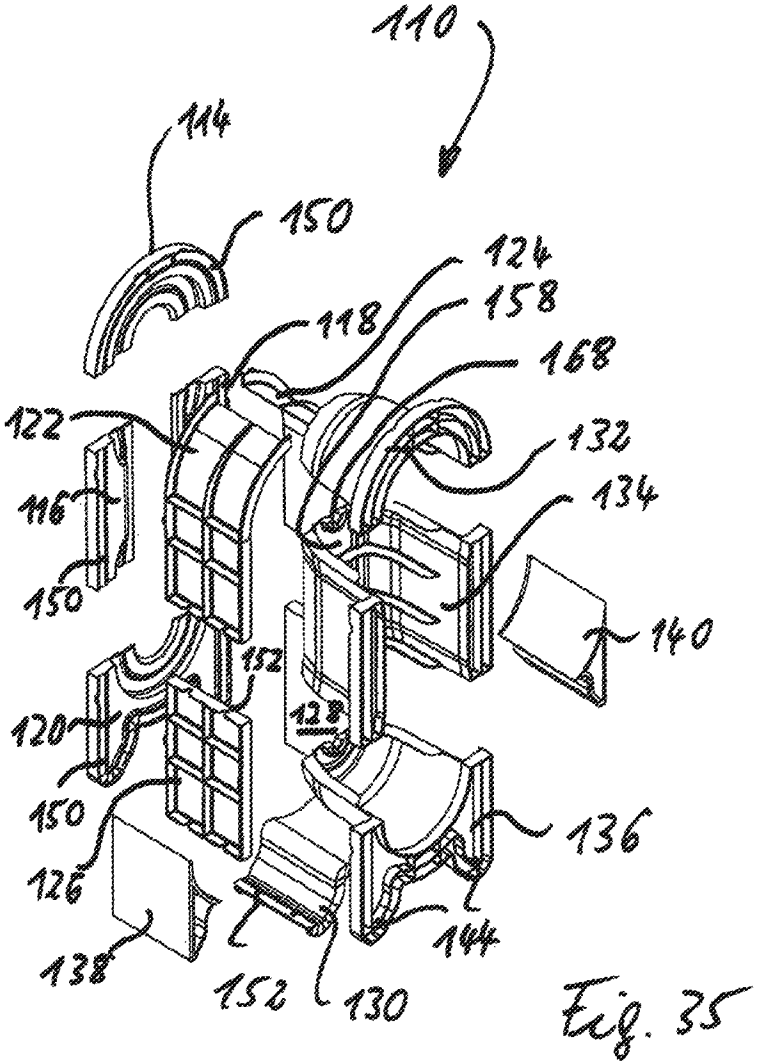
FIG. 35 is a perspective exploded view of a formwork for producing a block according to the invention, the formwork parts that form the second seating face of the wall block being closer to the viewer.

If a plurality of blocks 2 of FIGS. 29 to 32 are lined up end face to end face, each with the first seating face 4 facing downward, a kind of concreting formwork has been created into which concrete can be poured, with or without horizontal reinforcing bars 94. Due to the openings 96, after the concrete has set a concrete beam is obtained having a length that is several times the length l of a block 2. In particular window lintels or door lintels 100, as shown in FIG. 34, can be erected in this way. It goes without saying that window lintels or door lintels 100 or the like have to be supported from below until the concrete has set.

Figure 33:
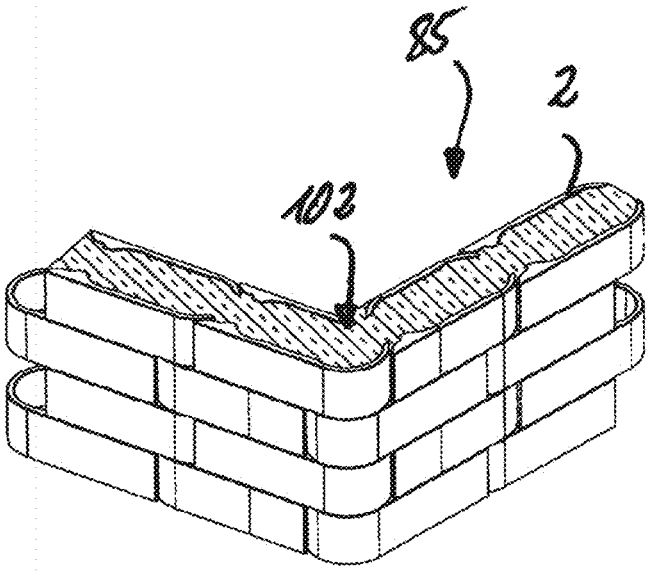
FIG. 33 is a perspective view of a detail of a wall which has been erected using blocks according to the invention.

FIG. 33 shows a further area of application of blocks 2 of the type shown in FIGS. 29 to 32. FIG. 33 shows a corner anchor 102 which extends from one wall corner 86 consisting of a plurality of block lengths to one side and to the other side, thus stabilizing the wall corner 86. It can be seen in FIG. 33 that in one of the two blocks 2 most closely adjacent to the wall corner 86, an opening 96 must be provided asymmetrically at the transition of an end face 14 or 16 into one of the wall surface sides 18 or 20, so that the corner anchor 102 forms a continuous corner concrete beam here. The corner anchor 102 can be expanded to form an annular anchor which extends e.g. around the upper edge of an external building wall.

FIGS. 29 to 34 show that in the uppermost block level, where the concrete fillings are introduced, the blocks 2 must be positioned with their first seating face 4 (where the extension arrangements 10 are located) facing downward. This can be achieved by positioning the blocks, from the first, lowermost block level upward, with the first seating face 4 facing downward. Another possibility is to work with blocks 2 at the second highest block level, for example, which, as special blocks, do not have any extension arrangements 10, but only receiving arrangements 40 on both seating faces 4 and 6.

FIGS. 35 to 38 show a formwork 110 or a mold 110 by means of which blocks 2 according to the invention of different designs can be produced. In order to produce a block 2, pourable concrete is poured into the mold 110 via an opening 112. After the concrete has hardened, the mold 110 is opened and the block 2 is removed.

The formwork 110 has the following formwork parts:

Four formwork parts 114, 116, 118, 120 for forming the first seating face 10 of a block 2 to be produced, which is designed as shown in FIG. 6;

five formwork parts 122, 124, 126, 128, 130 for forming the lateral surface 8 of the block 2;

three inner formwork parts 132, 134, 136, which are also formwork parts for forming the second seating face 12 of the block 2;

two insertion formwork parts 138, 140, which are left aside when a block 2 having two fins 60 is to be produced.

For details on the design of the above-mentioned formwork parts, reference is expressly made to FIGS. 35 to 38.

Roughly speaking, the formwork part 114 has the shape of a semicircular ring, the formwork parts 116, 118 have a rectangular shape, and the formwork part 120 has the shape of a semicircular ring having two extensions 142 which point downward in FIGS. 35 to 38. Roughly speaking, the formwork parts 122, 124 have the shape of a plate which is curved in an arc shape over approximately 80° in its upper portion (in order to form slightly less than half of the second end face 16 of the block 2) and is flat in its lower portion (in order to form part of a wall surface side 18 or 20 of the block 2). The formwork parts 126, 128 have the shape of a flat plate (for forming the remaining parts of the wall surface sides 18 and 20 of the block 2 and for forming the outer surfaces 62 of the two fins 60 of the block 2). The formwork part 130 has a shape for forming the first end face 14 together with the inner surfaces 70 of the two fins 60 of the block 2. Roughly speaking, the formwork part 132 has the shape of a bowl that is halved in its central axis plane having an outwardly protruding rim, the formwork part 136 has an identical shape, although with two extensions 144 of the rim projecting downward in FIGS. 35 to 38, and the formwork part 134 has the shape of a channel having two outwardly protruding rim portions. All the above-mentioned formwork parts are made of plastics material and are provided with reinforcing ribs in regions that do not face the cavity of the formwork to be filled with concrete.

Figure 37:
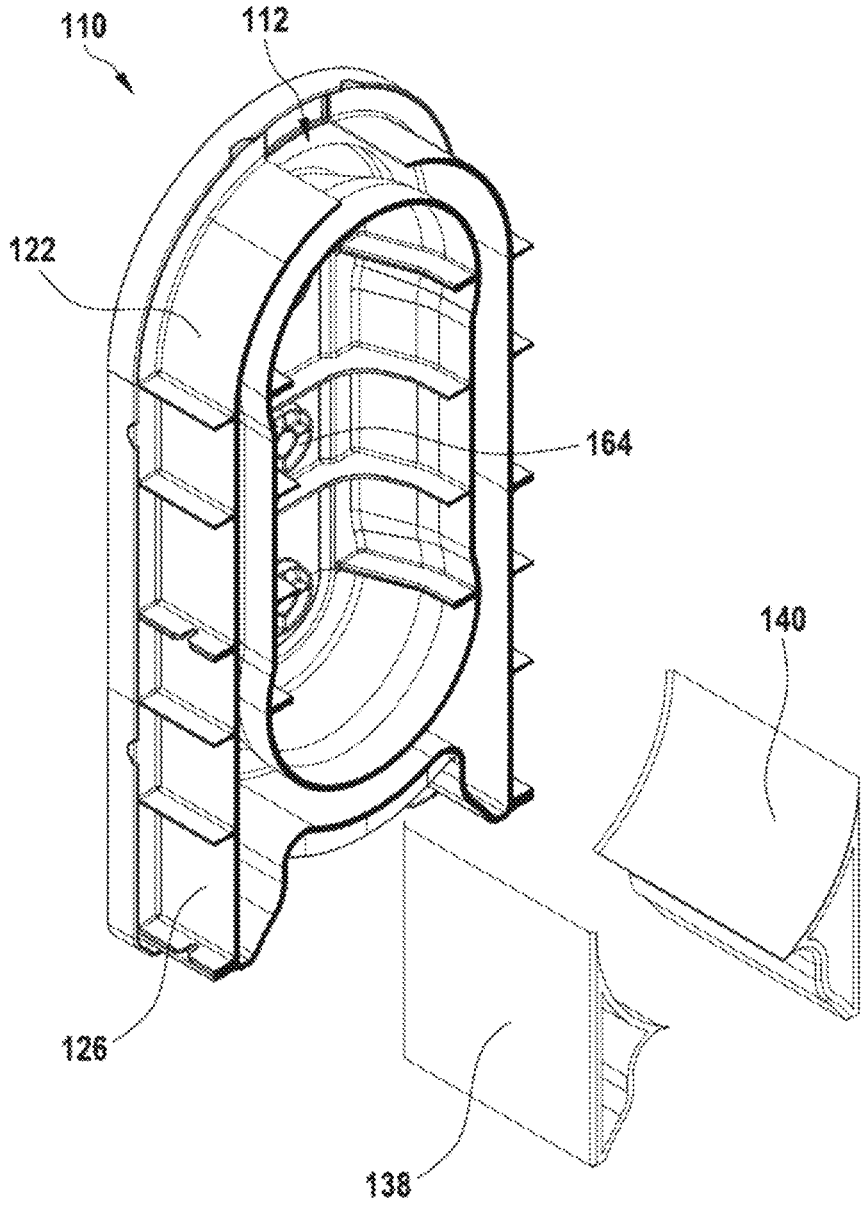
FIG. 37 is a section of the formwork of FIG. 35 in a plane which is approximately midway between the first and second seating faces in the produced wall block.
Figure 38:
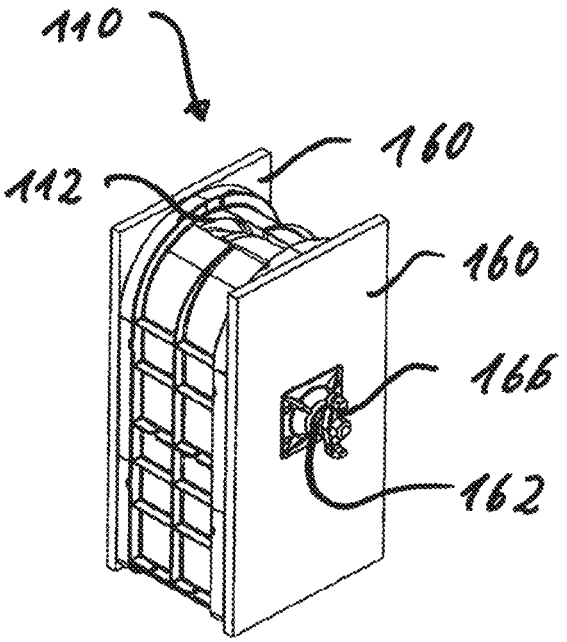
FIG. 38 is a perspective view of the formwork of FIG. 35 in the clamped state.

The above-mentioned formwork parts, with the exception of the insertion formwork parts 138, 140, are closely assembled for use, as shown in FIGS. 37 and 38. The formwork parts 114, 116, 118, 120, 132, 134, 136 have grooves 150 which edge regions of the formwork parts 122, 124, 126, 128, 130 enter in a form-fitting manner. The formwork parts 122, 124, 126, 128, 130 have, at the edges thereof which are adjacent to another formwork part in each case, closed holes 152 or holes that are open on one side, so that connecting screws can be fitted there. The closely assembled formwork parts 114, 116, 118, 120 delimit an opening 154, which roughly speaking has the shape of a slot with semicircular ends. The bowl bottoms 156 of the formwork parts 132, 136 and the channel bottom 158 of the formwork part 134 extend into this opening 154 in order to form the passage 52 in this way.

The formwork parts, which are closely assembled in the manner described, are assembled between two outer pressure plates 160 in the manner of a sandwich, by a central tension rod 162 being attached. The tension rod 162 is a metal rod having an external thread in each end region. It extends at a right angle to the plates 160 and passes through an opening 164 in the channel bottom 158 of the formwork part 134. Nuts 166 are screwed onto the two ends of the tension rod 162, such that the tension rod 162 tightens the entire sandwich described. The filling opening 112 for concrete can be seen at the top of FIGS. 37 and 38. The formwork 110 is filled with concrete in the position shown in FIGS. 37 and 38.

By installing one of the two insertion parts 138 or 140 when assembling the formwork 110, a block 2 having only one fin 60 can be produced, and by installing both insertion parts 138 and 140, a block 2 completely without fins 60 can be produced, as shown in FIGS. 1 to 3. If it is desired to manufacture a block 2 having three or four fins 60, it would be necessary to replace the rounded portions of the formwork parts 122 and 124 with a formwork part such as formwork part 130, the formwork part 114 with a formwork part such as formwork part 120, and the formwork part 132 with a formwork part such as formwork part 136. In addition, instead of the filling opening 112, a filling opening would be provided on each of the extensions 142, 144 that form the upwardly protruding fins 60 of the block 2.

By leaving out the formwork parts 116, 118, 126, 128, 134 and providing shorter formwork parts instead of the formwork parts 128 and 128, it is easy to produce a formwork 110 that is suitable for forming a block 2 which—with the exception of any fins 60—has an equal length and width. The two half-openings 168 in the bowl bottom 156 of the formwork parts 132, 136 complete one another to form a full circular opening through which the tension rod passes. For working with insertion parts 138, 140 and producing blocks 2 without fins 60 and blocks 2 having one, two, three or four fins 60, the statements made in the previous paragraph apply accordingly.

What is claimed is:

1. A wall block made of artificial stone material, having the following features:

the wall block has an overall elongate form with a longitudinal central axis (L) and with a length (l) that is greater than the width (b) of the wall block, and the wall block comprises:

a first seating face which is provided as an upper face of the wall block or as a lower face of the wall block;

an opposing second seating face which is provided as the other of the upper face of the wall block or lower face of the wall block;

a first end face which is provided to face a first further wall block which is adjacent to the claimed wall block in the longitudinal direction;

an opposing second end face which is provided to face a second further wall block which is adjacent to the claimed wall block in the longitudinal direction;

a first wall surface side which is provided to be part of a first wall surface;

an opposing second wall surface side which is provided to be part of an opposing second wall surface;

the wall block has, on its first seating face, a first seating surface which is provided for compressive-force transmission with at least a third further wall block that is adjacent in height;

the wall block has, on its second seating face, a second seating surface which is provided for compressive-force transmission with at least a fourth further wall block that is adjacent in height;

the wall block has a lateral surface which extends on its first end face, its first wall surface side, its second end face and its second wall surface side;

the wall block has exactly two extension arrangements arranged in a row on its first seating face and exactly two receiving arrangements arranged in a row on its second seating face, the extension arrangements and the receiving arrangements each being complementary to one another such that a particular extension arrangement fits in form-fitting engagement with a particular receiving arrangement of a third further wall block which is designed as a receiving arrangement of the claimed wall block, and such that a particular receiving arrangement fits in form-fitting engagement with a particular extension arrangement of a fourth further wall block which is designed as an extension arrangement of the claimed wall block, the particular extension arrangement and the particular receiving arrangement being designed such that the form-fitting engagement, considered per se, is possible both when the longitudinal central axes (L) of the claimed wall block and of the third further or fourth further wall block are parallel to one another and when the longitudinal central axes (L) of the claimed wall block and of the third further or fourth further wall block, seen in plan view of the first seating face or the second seating face of the claimed wall block, extend at an angle to one another;

the centers of the two extension arrangements and the centers of the two receiving arrangements are symmetrical to the transverse central axis of the wall block, which is located between the center of the first end face and the center of the second end face;

the centers of the two extension arrangements and the centers of the two receiving arrangements have a spacing from one another which corresponds substantially to half the length (l) of the wall block, measured between the centers of the first end face and the second end face;

the wall block has a single free passage or a plurality of free passages passing from its first seating face to its second seating face;

the wall block comprises a peripheral wall, the outer face of which forms the said lateral surface of the wall block, wherein the peripheral wall surrounds the said free passage or the said plurality of free passages;

each extension arrangement comprises a continuous arched rib or an interrupted arched rib arranged on the peripheral wall that surrounds the said free passage or the said plurality of free passages; and the wall block is formed having a first fin at the transition between its first end face and its first wall surface side, and a second fin at the transition between its first end face and its second wall surface side, wherein the first fin and the second fin protrude beyond a virtual flat surface located at the center of the first end face at a right angle to the longitudinal axis (L) of the wall block.

2. The wall block according to claim 1, characterized in that each extension arrangement has such a design of its outer face facing outward away from the center of the extension arrangement and each receiving arrangement has such a design of its inner face facing inward toward the center of the receiving arrangement that continuous arched, form-fitting engagement or interrupted arched, form-fitting engagement with the complementary receiving arrangement and extension arrangement), respectively, of the third further or fourth further wall block is possible, wherein at the outer face of each extension arrangement and at the inner face of each receiving arrangement, the design for arched form-fitting engagement extends over an angular range having a size of at least 180° and at most 360°.

3. The wall block according to claim 2, wherein at the outer face of each extension arrangement and at the inner face of each receiving arrangement, the design for arched form-fitting engagement extends over an angular range having a size of slightly greater than 180°.

4. The wall block according to claim 1, characterized in that its first end face and/or its second end face is outwardly convex and semicircularly rounded, with the exception of the regions where the above-mentioned first and second fins protrude.

5. The wall block according to claim 1, characterized in that the end face(s) on which the first and second fins are provided is/are set back toward the wall block in comparison with the central region of a virtual arc which begins tangentially in the center of the relevant end face and extends to the end of the respective fin, the extent to which it is/they are set back being so great that an empty pocket remains there when a first further wall block or a second further wall block having an overall outwardly convex and semicircularly rounded end face is positioned adjacently.

6. The wall block according to claim 1, characterized in that, in the case of each extension arrangement, a portion of its first seating surface is located between its outer face facing outward from the center (and the lateral surface of the wall block located there.

7. The wall block according to claim 1, characterized in that it has a single free passage passing from its first seating face to its second seating face;

in that it consists—with the exception of the above-mentioned first and second fins—substantially only of a peripheral wall having two rounded portions on two end faces of the wall block and two straight portions between the two rounded portions, as well as two extension arrangements and two receiving arrangements;

in that the two extension arrangements are offset toward the inside of the wall block (2) with respect to the main part of the height of the peripheral wall;

and in that the two receiving arrangements are formed using portions of the inner faces of the rounded portions.

8. The wall block according to claim 7, characterized in that the two straight portions of the peripheral wall each have a greater wall strength in their central regions than the wall strength of the peripheral wall in the rounded portions;

and in that, on the first seating face, the first seating surface is widened in each case in the region of the relevant above-mentioned central region toward the inside of the wall block, beyond the above-mentioned greater wall thickness.

9. The wall block according to claim 1, characterized in that an opening is provided in each case in its first end face and its second end face.

10. The wall block according to claim 1, characterized in that it has an integrally formed or separately inserted end plate adjacent to its first seating face or its second seating face;

and in that an opening is provided in each case in its first end face and its second end face.

11. A wall, characterized in that it has at least one portion in which a plurality of wall blocks according to claim 1 are incorporated.

12. The wall according to claim 11, characterized in that it has at least one bend in its longitudinal extension direction, which bend is formed by means of the above-mentioned variable-angle form-fitting engagement of an extension arrangement and a receiving arrangement.

13. The wall according to claim 11, characterized in that it has at least one T-cross connection and/or at least one X-cross connection (88).

14. The wall according to claim 11, characterized in that it has at least one lintel over a wall opening and/or at least one wall anchor extending longitudinally in the wall, the lintel or the wall anchor containing claimed wall blocks filled with concrete.

15. A formwork for producing a wall block made of artificial stone material according to claim 1, characterized in that the formwork is composed of a plurality of formwork parts and can be disassembled in order to remove the formwork from the wall block, and in that the formwork parts of the formwork include a formwork part or a plurality of formwork parts for forming the first seating face, a formwork part or a plurality of formwork parts for forming the second seating face, and a formwork part or a plurality of formwork parts for forming the lateral surface.

16. The formwork according to claim 15, characterized in that the formwork parts include an inner formwork part or a plurality of inner formwork parts for forming a single continuous passage or a plurality of continuous passages of the wall block.

17. The formwork according to claim 15, characterized in that it has at least one insertion part by means of which a partial interior of the formwork can be occupied and thereby removed from the starting cavity of the formwork.

18. The formwork according to claim 17, wherein the at least one insertion part is provided for a partial interior which serves to form a fin without the insertion part.

19. The formwork according to claim 15, characterized in that the formwork parts are held together by means of a tension rod or a plurality of tension rods.

* * * * *